US010657891B2

(12) United States Patent
Kim et al.

(10) Patent No.: US 10,657,891 B2
(45) Date of Patent: May 19, 2020

(54) SOURCE DRIVING CIRCUIT AND DISPLAY DEVICE INCLUDING THE SAME

(71) Applicant: SAMSUNG ELECTRONICS CO., LTD., Suwon-si, Gyeonggi-do (KR)

(72) Inventors: In-Suk Kim, Suwon-si (KR); Chan-Bong Yu, Seoul (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 16/126,575

(22) Filed: Sep. 10, 2018

(65) Prior Publication Data

US 2019/0156764 A1 May 23, 2019

(30) Foreign Application Priority Data

Nov. 20, 2017 (KR) ..... 10-2017-0155124

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/2003* (2013.01); *G09G 3/2092* (2013.01);
(Continued)

(58) Field of Classification Search
CPC ..... G09G 2330/025; G09G 3/3291; G09G 3/2003; G09G 2310/066; G09G 2330/06; G09G 2310/00; G09G 3/3208; G09G 3/32; G09G 3/30; G09G 3/22; G09G 3/2092; G09G 3/20; G09G 3/00; G09G 2330/021;
(Continued)

(56) References Cited

U.S. PATENT DOCUMENTS 5,812,105 A * 9/1998 Van de Ven ..... G09F 9/33 257/E25.02
6,970,153 B2 11/2005 Park
(Continued)

FOREIGN PATENT DOCUMENTS

KR 10-2007-0070818 7/2007
KR 100880223 1/2009

*Primary Examiner* — Julie Anne Watko
(74) *Attorney, Agent, or Firm* — F. Chau & Associates, LLC

(57) ABSTRACT

A source driving circuit of a display device includes a plurality of unit driving circuits configured to drive a plurality of connection nodes connected to a display panel. Each unit driving circuit includes a plurality of driver circuits and output switches. The driver circuits perform analog-conversion and amplification operations on a plurality of digital data signals to generate a plurality of analog data signals. The output switches are connected in parallel between the driver circuits and a corresponding connection node among the plurality of connection nodes. The output switches transfer the plurality of analog data signals alternately to the corresponding connection node. Each one of the plurality of connection nodes may be driven by more than one of the plurality of driver circuits. The source settling time is reduced and performance of the display device is enhanced by disposing a plurality of unit driving circuits to each connection node.

18 Claims, 20 Drawing Sheets

(51) Int. Cl.

| | |
|---|---|
| ***G09G 3/3275*** | (2016.01) |
| ***G09G 3/30*** | (2006.01) |
| ***G09G 3/3291*** | (2016.01) |
| ***G09G 3/36*** | (2006.01) |
| *G09G 3/3225* | (2016.01) |

(52) U.S. Cl.
CPC ..... *G09G 3/3291* (2013.01); *G09G 3/3685* (2013.01); *G09G 3/3225* (2013.01); *G09G 3/3275* (2013.01); *G09G 3/3648* (2013.01); *G09G 2310/0297* (2013.01); *G09G 2310/066* (2013.01); *G09G 2320/0223* (2013.01); *G09G 2320/0252* (2013.01); *G09G 2330/025* (2013.01); *G09G 2330/06* (2013.01)

(58) Field of Classification Search
CPC ..... G09G 2330/02; G09G 2330/00; G09G 2310/06; G09G 3/3225; G09G 2320/0223; G09G 2320/0252; G09G 2310/0297; G09G 3/3233; G09G 3/3275; G09G 3/3685; G09G 3/3648; G06G 3/3275
See application file for complete search history.

(56) References Cited

U.S. PATENT DOCUMENTS

| | | | | |
|---|---|---|---|---|
| 8,466,909 | B2 | 6/2013 | An et al. | |
| 8,599,179 | B2 * | 12/2013 | Kim | G09G 3/3614 345/204 |
| 8,648,637 | B2 | 2/2014 | Kim et al. | |
| 9,543,912 | B2 * | 1/2017 | Lee | H03F 3/301 |
| 2006/0244710 | A1 * | 11/2006 | Iriguchi | G09G 3/3266 345/100 |
| 2009/0231319 | A1 * | 9/2009 | Tsuchi | G09G 3/3688 345/211 |
| 2012/0038614 | A1 * | 2/2012 | Mizumaki | G09G 3/3614 345/211 |
| 2012/0081338 | A1 * | 4/2012 | Kim | G09G 3/3614 345/204 |
| 2015/0084694 | A1 * | 3/2015 | Lee | H03F 3/301 330/255 |
| 2016/0118875 | A1 * | 4/2016 | Lee | H02M 1/08 345/212 |
| 2017/0004799 | A1 | 1/2017 | Park et al. | |
| 2017/0169755 | A1 * | 6/2017 | Tamura | G09G 3/2092 |
| 2018/0024678 | A1 * | 1/2018 | Nitobe | G06F 3/0418 345/174 |
| 2018/0337687 | A1 * | 11/2018 | Adjiwibawa | H03M 1/662 |

* cited by examiner

FIG. 18

| | XP1 | | XP2 | | XP3 | | XP4 | | XP5 | | 비고 |
|---|---|---|---|---|---|---|---|---|---|---|---|
| | Tr[us] | Tf[us] | Tr[us] | Tf[us] | Tr[us] | Tf[us] | Tr[us] | Tf[us] | Tr[us] | Tf[us] | |
| CASE1 | 0 | 0 | 0.557 | 0.557 | 0.626 | 0.627 | 0.736 | 0.738 | 0.782 | 0.782 | |
| CASE2 | 0.534 | 0.562 | 0.534 | 0.795 | 0.817 | 0.861 | 0.919 | 0.965 | 0.968 | 0.996 | SPEC OUT |
| CASE3 | 0.457 | 0.429 | 0.676 | 0.663 | 0.737 | 0.729 | 0.851 | 0.835 | 0.883 | 0.869 | SPEC IN |

SOURCE DRIVING CIRCUIT AND DISPLAY DEVICE INCLUDING THE SAME

CROSS-REFERENCE TO RELATED APPLICATION

This U.S. Non-provisional application claims priority under 35 USC § 119 from Korean Patent Application No. 10-2017-0155124, filed on Nov. 20, 2017, in the Korean Intellectual Property Office (KIPO), the disclosure of which is incorporated by reference herein in its entirety.

TECHNICAL FIELD

Example embodiments of the inventive concept relate generally to semiconductor integrated circuits, and more particularly to a source driving circuit and a source settling time of a display device including a source driving circuit.

DISCUSSION OF THE RELATED ART

As a resolution of a display panel included in a display device increases, an operation frequency of a source driving circuit to drive the display panel increases. As the operation frequency of the source driving circuit increases, a source settling time of the source driving circuit is shortened. In addition, as a size and a resolution of the display panel increase, a load of the source driving circuit increases and the increase of the load is one of the factors that may cause an increase in the source settling time. The source settling time indicates a threshold time interval for which a data voltage or a driving voltage output from the source driving circuit has to be stabilized at a certain voltage level at a corresponding pixel position in the display panel. To shorten the source settling time, a slew rate of a data voltage from the source driving circuit may be increased. However, there are certain limitations associated with increasing a driving capacity or a driving voltage level of the source driving circuit to increase the slew rate. In addition, a faster slew rate of the data voltage causes a higher current peak, and the higher current peak causes electromagnetic interference and capacitive noise in the display device.

SUMMARY

Some example embodiments of the inventive concept may provide a source driving circuit and a display device including a source driving circuit capable of efficiently reducing a source settling time.

According to example embodiments of the inventive concept, a source driving circuit of a display device may include a plurality of unit driving circuits configured to drive a plurality of connection nodes that are connected to a display panel of the display device. Each of the plurality of unit driving circuits includes a plurality of driver circuits and a plurality output switches. The a plurality of driver circuits configured to perform analog-conversion and amplification operations on a plurality of digital data signals to generate a plurality of analog data signals so that each connection node of the plurality of connection nodes is driven by more than one of the plurality of driver circuits. The plurality of output switches are connected in parallel between the plurality of driver circuits and a corresponding connection node among the plurality of connection nodes. The plurality of output switches transfer the plurality of analog data signals alternately to the corresponding connection node.

In some embodiments of the inventive concept, the input switches included in each input switch group are alternately turned on.

According to example embodiments of the inventive concept, a source driving circuit of a display device may include a plurality of driver circuits having a first driver circuit configured to perform analog-conversion and amplification operations on a first digital data signal received through a first input node to output a first analog data signal through a first output node, and a second driver circuit configured to perform analog-conversion and amplification operations on a second digital data signal received through a second input node to output a second analog data signal through a second output node. A first output switch is connected between the first output node and a connection node connected to a display panel of the display device; and a second output switch connected between the second output node and the connection node; and wherein the connection node is driven by two or more driver circuits of the plurality of driver circuits.

According to example embodiments of the inventive concept, a display device may include a display panel including a plurality of pixels connected to a plurality of data lines and a plurality of gate lines and a source driving circuit comprising a plurality of unit driving circuits configured to drive a plurality of connection nodes that are connected to the display panel. Each of the plurality of unit driving circuits includes a plurality of driver circuits configured to perform analog-conversion and amplification operations on a plurality of digital data signals, and to output a plurality of analog data signals and a plurality of output switches connected in parallel between the plurality of driver circuits and a corresponding connection node among the plurality of connection nodes. The plurality of output switches transfer the plurality of analog data signals alternately to the corresponding connection node so that each connection node of the plurality of connection nodes is driven by more than one of the plurality of driver circuits.

The source driving circuit and the display device including the source driving circuit according to example embodiments of the inventive concept may reduce the source settling time and enhance performance of the display device by disposing a plurality of unit driving circuits to each connection node. One unit driving circuit may perform the analog-conversion and amplification operations with respect to a digital data signal corresponding to one pixel data while another unit driving circuit outputs an analog data signal corresponding to other pixel data to the connection node, and the source settling time may be shortened.

BRIEF DESCRIPTION OF THE DRAWINGS

Example embodiments of the inventive concept will be better appreciated by a person of ordinary skill in the art from the following detailed description taken in conjunction with the accompanying drawings.

FIGS. 17A, 17B, 17C and 18 are diagrams for describing reduction of a source settling time according to example embodiments of the inventive concept.

DETAILED DESCRIPTION OF THE EMBODIMENTS

Figure 1:
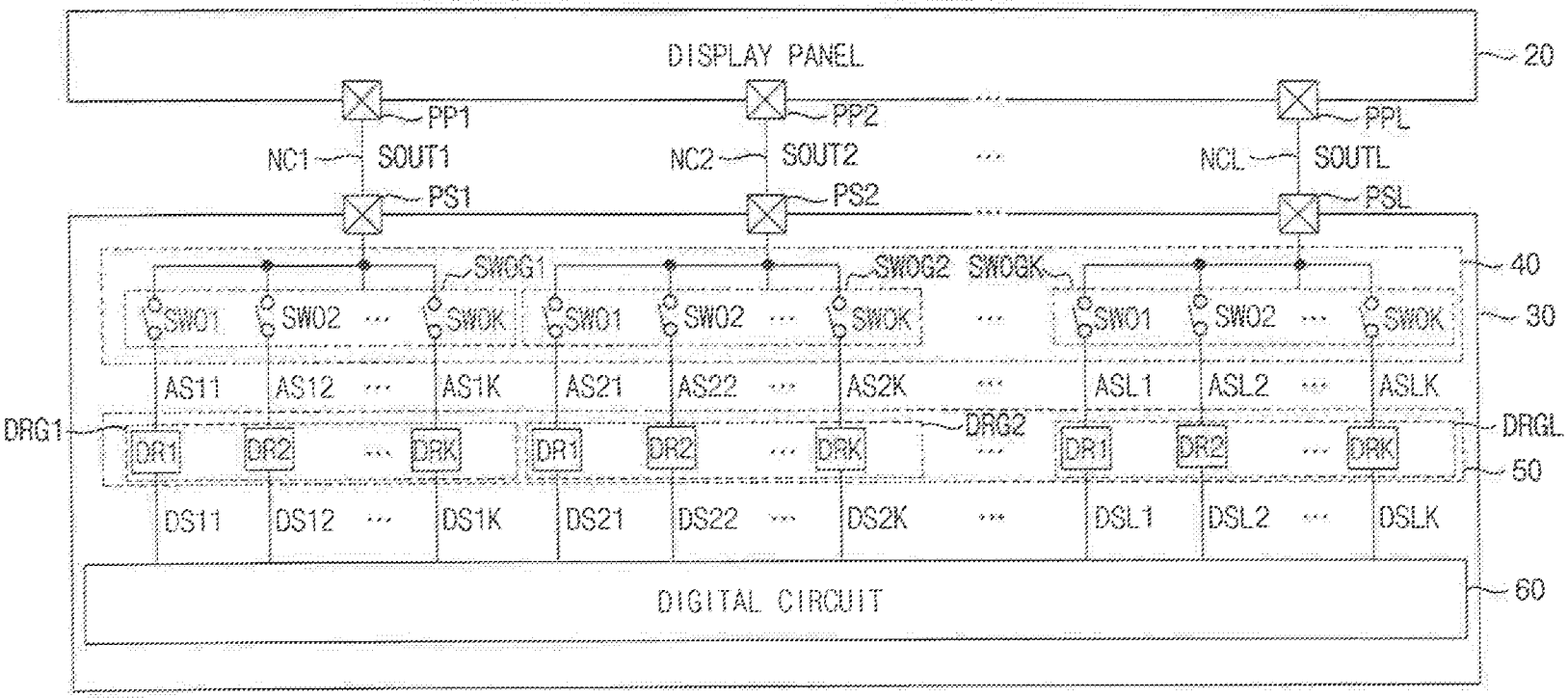
FIG. 1 is a block diagram illustrating a display device according to example embodiments of the inventive concept.

Various example embodiments of the inventive concept will be described more fully hereinafter with reference to the accompanying drawings, in which some example embodiments are shown. In the drawings, like numerals refer to like elements throughout. To avoid repetition, there may be an omission of the discussion of elements in a subsequent embodiment if such elements were discussed in a previous embodiment.

FIG. 1 is a block diagram illustrating a display device according to example embodiments of the inventive concept.

Referring to FIG. 1, a display device 10 may include a display panel 20 and a source driving circuit 30. FIG. 1 illustrates only a portion of the display device 10 associated with source driving according to example embodiments of the inventive concept. Overall configuration and operation will be described below with reference to FIGS. 4 through 6.

The display panel 20 and the source driving circuit 30 are connected through a plurality of connection nodes NC1~NCL. The connection nodes NC1~NCL may include data pads PP1~PPL of the display panel 20 and/or data pads PS1~PSL of the source driving circuit 30. As will be described herein below, each connection node may correspond to, or may be assigned to a plurality of data lines, and thus the number of connection nodes NC1~NCL may be less than the number of the data lines of the display panel 20.

The source driving circuit 30 may include a plurality of unit driving circuits 50 that are configured to drive the connection nodes NC1~NCL that are connected to the display panel 20. The unit driving circuits 50 may include a plurality of driver circuit groups DRG1~DRGL and a plurality of output switch groups SWOG1~SWOGL (e.g., output switch group 40). The driver circuit groups DRG1~DRGL are configured to perform an analog-conversion and amplification operations on a plurality of digital data signals DS11~DSLK to generate a plurality of analog data signals AS11~ASLK.

A first unit driving circuit includes a first driver circuit group DRG1 and a first output switch group SWOG1, a second unit driving circuit includes a second driver circuit group DRG2 and a second output switch group SWOG2 and in this way an L-th unit driving circuit includes a L-th driver circuit group DRCL and an L-th output switch group SWOGL.

With continued reference to FIG. 1, the first driver circuit group DRG1 performs the analog-conversion and amplification operations on first digital data signals DS11~DS1K to generate first analog data signals AS11~AS1K, a second driver circuit group DRG2 performs the analog-conversion and amplification operations on second digital data signals DS21~DS2K to generate second analog data signals AS21~AS2K, and in this way the L-th driver circuit group DRGL performs the analog-conversion and amplification operations on L-th digital data signals DSL1~DSLK to generate L-th analog data signals ASL1~ASLK. For such analog-conversion and amplification operations, each of the first through L-th driver circuit groups includes a plurality of driver circuits DR1~DRK.

A first output switch group SWOG1 is connected in parallel between the first connection node NC1 and the driver circuits DR1~DRK of the first driver circuit group DRG1. The first output switch group SWOG1 is configured to transfer the first analog signals AS11~AS1K alternately to the first connection node NC1 as a first output signal SOUT1. A second output switch group SWOG2 is connected in parallel between a second connection node NC2 and the driver circuits DR1~DRK of the second driver circuit group DRG2. The second output switch group SWOG2 is configured to transfer the second analog signals AS21~AS2K alternately to the second connection node NC2 as a second output signal SOUTL. In addition, an L-th output switch group SWOGL is connected in parallel between an L-th connection node NCL and the driver circuits DR1~DRK of the L-th driver circuit group DRGL. The L-th output switch group SWOGL is configured to transfer the L-th analog signals ASL1~ASLK alternately to the L-th connection node NCL as an L-th output signal SOUTL. For such switching operations, each of the output switch groups SWOG1~SWOGL may include a plurality of output switches SWO1~SWOK.

Accordingly, the source driving circuit and the display device including the source driving circuit according to example embodiments of the inventive concept may reduce a source settling time and enhance performance of the display device by disposing a plurality of unit driving circuits to each connection node.

Hereinafter, example embodiments of the inventive concept will be described based on one unit driving circuit corresponding to one connection node. However, an artisan should understand and appreciate that with regard to embodiments of the inventive concept, a plurality of unit driving circuits to drive a plurality of connection nodes may have the same configuration as described with reference to FIG. 1. In addition, example embodiments will be described based on a unit driving circuit including two driver circuits and two output switches for convenience of illustration and description. An artisan should understand and appreciate that example embodiments may be applied to other configurations, for example, a configuration in which each unit driving circuit includes three or more driver circuits and three or more output switches.

Figure 2:
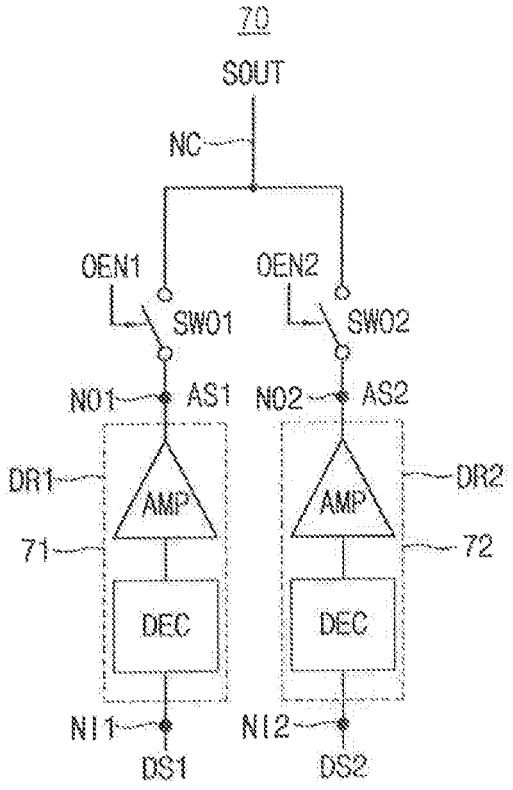
FIG. 2 is a diagram illustrating an example embodiment of a unit driving circuit included in the display device of FIG. 1.

FIG. 2 is a diagram illustrating an example embodiment of the inventive concept of a unit driving circuit included in the display device of FIG. 1.

Referring to FIG. 2, a unit driving circuit 70 may include a first driver circuit 71, a second driver circuit 72, a first output switch SWO1 and a second output switch SWO2.

The first driver circuit 71 may perform analog-conversion and amplification operations on a first digital data signal DS1 received through a first input node NI1 to generate a first analog data signal AS1 through a first output node NO1. Moreover, the second driver circuit 72 may perform analog-conversion and amplification operations on a second digital data signal DS2 received through a second input node NI2 to generate a second analog data signal AS2 through a second output node NO2.

The first output switch SWO1 is connected to the first output node NO1 and to a connection node NC that is connected to the display panel. The second output switch SWO2 is connected to the second output node NO2 and to the connection node NC. For example, the first output switch SWO1 and the second output switch SWO2 are connected in parallel between the connection node NC and the first driver circuit 71 and the second driver circuit 72.

Each of the first driver circuit 71 and the second driver circuit 72 includes a decoder DEC and a source amplifier AMP. The decoder DEC may receive gamma voltages from a gamma voltage generation circuit (not shown) and receives the digital data signals DS and DS2 from the digital circuit 60 in FIG. 1. Each of the digital data signals DS1 and DS2 may include pixel data corresponding to pixels in the display panel 20 that will be described below with reference to FIG. 3. The decoder DEC may output one of the gamma voltages based on the received pixel data. The source amplifier AMP may amplify a voltage from the decoder DEC to generate each of the analog data signals AS1 and AS2. The decoder DEC and the source amplifier AMP may be implemented in various configurations.

The first output switch SWO1 may perform a switching operation in response to a first output enable signal OEN1, and the second output switch SWO2 may perform a switching operation in response to a second output enable signal OEN2. As will be described below with reference to FIG. 3, the first output enable signal OEN1 and the second output signal OEN2 may be alternately activated, and thus the first output switch SWO1 and the second output switch SWO2 may be turned on alternately. In other words, the unit driving circuit 70 may provide the first analog data signal AS1 and the second analog data signal AS2 alternately as an output signal SOUT to drive the connection node NC.

As will be subsequently described herein with reference to FIG. 6, the decoders DEC may be included in a decoder circuit 133, the source amplifiers AMP may be included in an amplification circuit 134 and the output switches SWO1 and SWO2 may be included in an output switch circuit 135. In an embodiment, the output switch circuit may be a switch array. Alternatively, the output switch circuit 135 may include a plurality of switches arranged in a plurality of groups.

Figure 3:
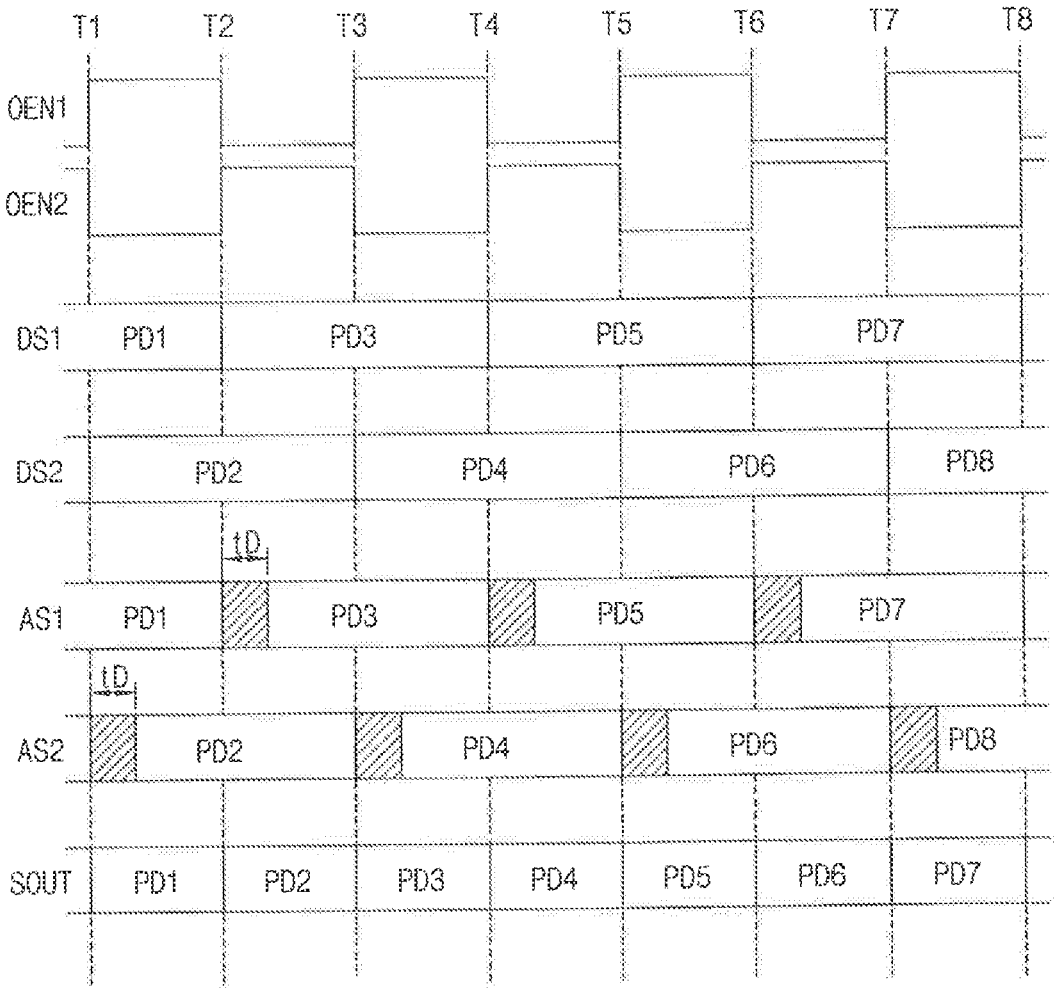
FIG. 3 is a timing diagram illustrating an operation of the unit driving circuit of FIG. 2.

FIG. 3 is a timing diagram illustrating an operation of the unit driving circuit of FIG. 2.

Referring now to FIGS. 2 and 3, the first output enable signal OEN1 and the second output enable signal OEN2 may toggle or be activated alternately at time points T1~T8. The first output switch SWO1 and the second output switch SWO2 may be turned on alternately in response to receiving the first output enable signal OEN1 and the second output enable signal OEN2.

The first digital data signal DS1 and the second digital data signal DS2 may include pixel data PD1~PD8 corresponding to pixels included in the display panel, respectively. For example, as illustrated in FIG. 3, the first digital data signal DS1 may sequentially include the odd-numbered pixel data PD1, PD3, PD5 and PD7 and the second digital data signal DS2 may sequentially include even-numbered pixel data PD2, PD4, PD6 and PD8. The data changing time points of the first digital data signal DS1 correspond to the activation time points T2, T4, T6 and T8 of the second output enable signal OEN2. In addition, the data changing time points of the second digital signal DS2 correspond to the activation time points T1, T3, T5 and T7 of the first output enable signal OEN1. The generation of the digital data signals DS1 and DS2 will be described below with reference to FIGS. 8 and 9.

The first driver circuit 71 performs analog-conversion and amplification operations on the first digital data signal DS1 to generate the first analog data signal AS1. The second driver circuit 72 performs analog-conversion and amplification operations on the second digital signal DS2 to generate the second analog data signal AS2. As illustrated in FIG. 3, first analog data signal AS1 and the second analog data signal AS2 include pixel data PD1~PD8 corresponding to digital-to-analog conversion of the first digital data signal DS1 and the second digital signal DS2, respectively.

The analog-conversion and amplification operations utilize a delay time tD that is considerable in comparison with a delay time of a digital circuit such as a switch circuit. Accordingly, the first analog data signal AS1 and the second analog data signal AS2 may have stabilized voltage levels corresponding to the pixel data after the delay time tD from time points when the pixel data of the first digital data signal DS1 and the second digital signal DS2 are received. If the outputs of the first driver circuit 71 and the second driver circuit 72, for example, the analog data signals AS1 and AS2, are provided directly to the corresponding connection nodes, the delay time tD may become a cause of an increased source settling time of the display device.

According to example embodiments of the inventive concept, each of the first driver circuit 71 and the second driver circuit 72 may receive a corresponding digital data signal among the first digital data signal DS1 and the second digital data signal DS2 to generate a corresponding analog data signal among the first analog data signal AS1 and the second analog data signal AS2 in advance before transferring the corresponding analog data signal to the corresponding connection node NC.

For example, the first driver circuit 71 may receive the third pixel data PD3 in advance at the second time point T2 when the second output enable signal OEN2 is activated to perform the analog-conversion and amplification operations on the third pixel data PD3 and the first driver circuit 71 may stabilize the first analog data signal AS1 to a voltage level corresponding to the third pixel data PD3 after the delay time tD. After that, at the third time point T3, the first output switch SWO1 is turned on and a voltage corresponding to the third data PD3 may be output promptly to the connection node NC.

Similar to the operation of the first driver circuit 71, the second driver circuit 72 may receive the fourth pixel data PD4 in advance at the second time point T3 when the first output enable signal OEN1 is activated to perform the analog-conversion and amplification operations on the fourth pixel data PD4 and the second driver circuit 72 may stabilize the second analog data signal AS2 to a voltage level corresponding to the fourth pixel data PD4 after the delay time tD. After that, at the fourth time point T4, the second output switch SWO2 is turned on and a voltage corresponding to the fourth data PD4 may be output promptly to the connection node NC.

Accordingly, the source driving circuit and the display device including the source driving circuit according to example embodiments of the inventive concept may reduce the source settling time efficiently by performing the analog-conversion and amplification operations on one pixel data using one unit driving circuit while another unit driving circuit outputs an analog data signal corresponding to other pixel data to the connection node.

Figure 4:
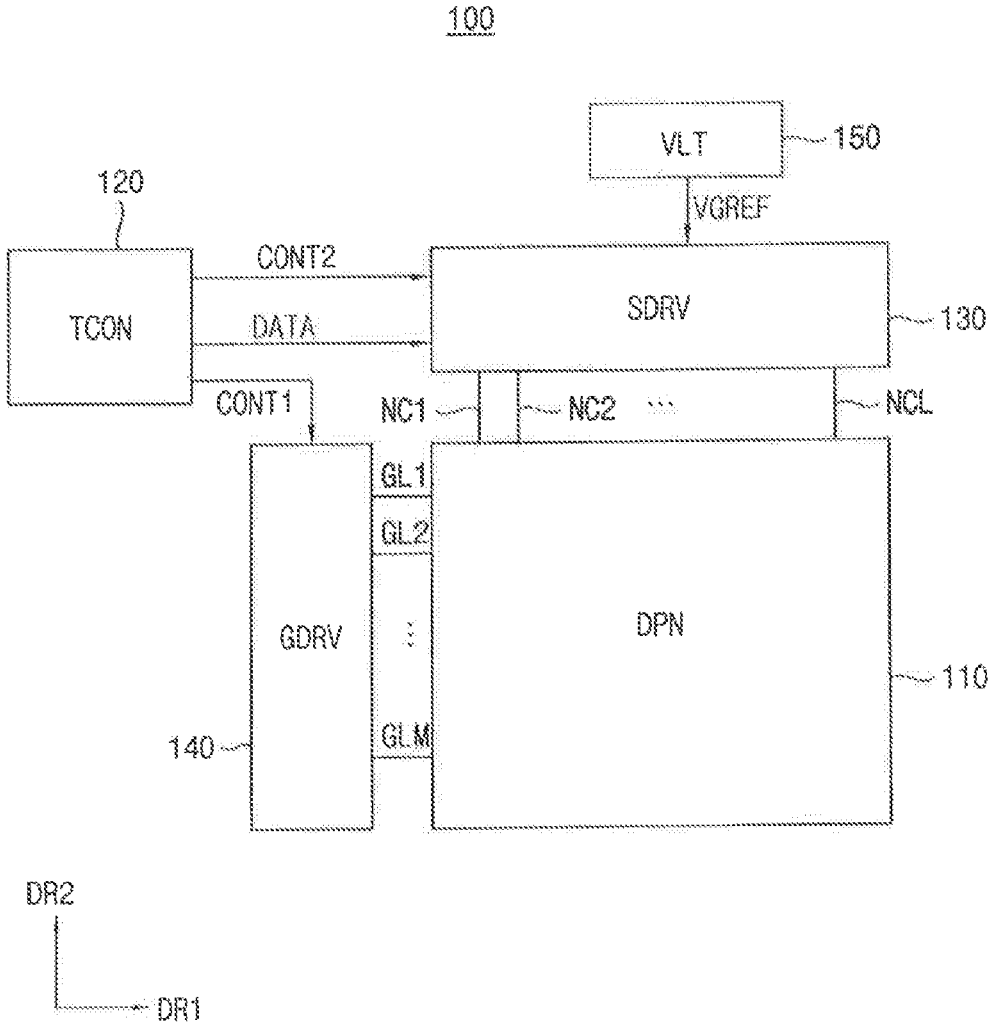
FIG. 4 is a block diagram illustrating a display device according to example embodiments of the inventive concept.
Figure 5A:
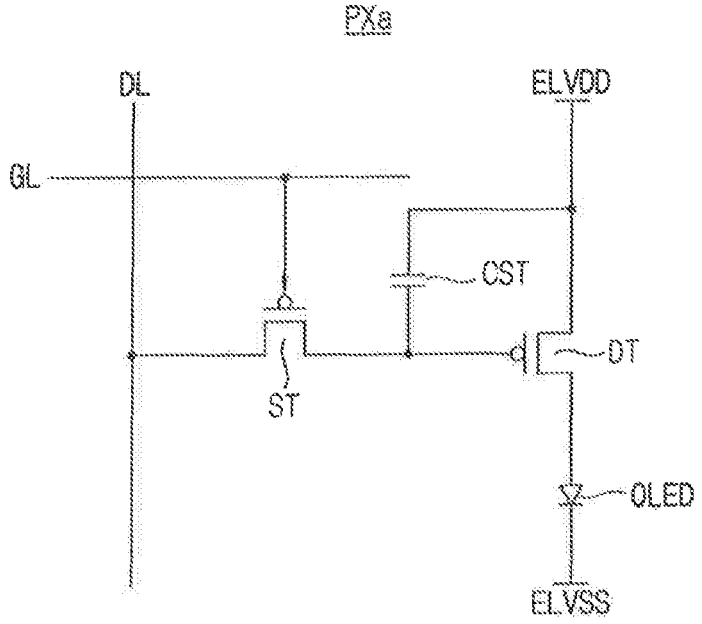
FIGS. 5A and 5B are circuit diagrams included in a display panel in FIG. 4.
Figure 5B:
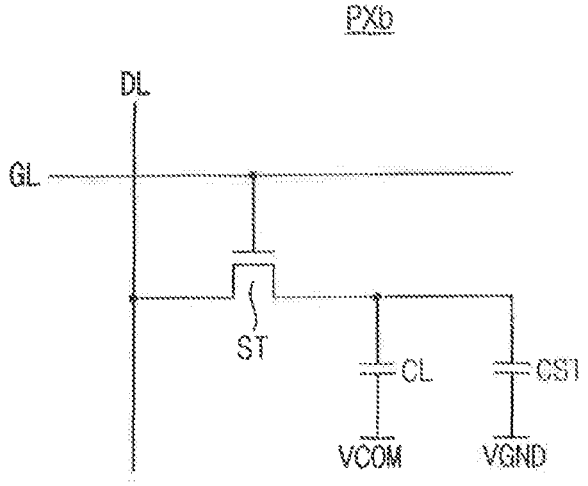

FIG. 4 is a block diagram illustrating a display device according to example embodiments of the inventive concept, and FIGS. 5A and 5B are circuit diagrams included in a display panel in FIG. 4.

Referring to FIG. 4, a display device 100 includes a display panel (DPN) 110 and a driving circuit. The driving circuit includes a timing controller (TCON) 120, a data driving circuit or a source driving circuit (SDRV) 130, a gate driving circuit (GDRV) 140 and a gamma voltage generator (VLT) 150. Although not illustrated in FIG. 4, the display device 100 may further include other components such as a buffer for storing image data to be displayed, a backlight unit, etc.

The display panel 110 includes a plurality of gate lines GL1~GLm extending in a row direction DR1, a plurality of data lines (not shown) and a plurality of pixels PX coupled to the gate lines GL1~GLM and the data lines. For example, the pixels PX may be arranged in a matrix form of m rows and n columns.

The data lines (not shown) may be connected to a plurality of connection nodes NC1~NCL, and the above-described unit driving circuits of the source driving circuit 130 may drive the data lines through the connection nodes NC1~NCL. As will be described below, two or more data lines may be connected to each of the connection nodes NC1~NCL.

In some example embodiments of the inventive concept, the display panel 110 in FIG. 4 may include electroluminescent pixels such as an organic light emitting diode (OLED) as illustrated in FIG. 5A.

Referring to FIG. 5A, a pixel PXa may include a switching transistor ST, a storage capacitor CST, a driving transistor DT and an OLED. The switching transistor ST has a first source/drain terminal connected to a data line DL or a source line, a second source/drain terminal connected to the storage capacitor CST, and a gate terminal connected to a gate line GL or a scan line. The switching transistor ST transfers a data signal received from the gate driving circuit 140 to the storage capacitor CST in response to a gate driving signal received from the gate driving circuit 140. The storage capacitor CST has a first terminal connected to a high power supply voltage ELVDD and a second terminal connected to the driving transistor DT. The storage capacitor CST stores the data signal transferred through the switching transistor ST. The driving transistor DT has a first source/drain terminal connected to the high power supply voltage ELVDD, a second source/drain terminal connected to the OLED, and a gate terminal connected to the storage capacitor CST. The driving transistor DT can be turned on or off according to the data signal stored in the storage capacitor CST. The OLED has an anode electrode connected to the driving transistor DT and a cathode electrode connected to a low power supply voltage ELVSS. The OLED can emit light based on a current flowing from the high power supply voltage ELVDD to the low power supply voltage ELVSS while the driving transistor DT is turned on. The structure of each pixel PXa, or a 2T1C structure including two transistors ST and DT and one capacitor CST, is but one non-limiting example of a pixel structure that is suitable for a large-sized display device. An artisan should understand and appreciate embodiments of the inventive concept may have different pixel constructions than shown.

For example, the structure of the pixel PXa shown in FIG. 5A does not limit the example embodiments of the display panel to the configuration shown. Electroluminescent pixels of various configurations may be utilized by the display panel according to some example embodiments of the inventive concept.

In some example embodiments of the inventive concept, the display panel 110 shown in FIG. 4 may include liquid crystal display (LCD) pixels that include a liquid crystal capacitor CL as illustrated in FIG. 5B.

Referring to FIG. 5B, a pixel PXb may include a switching transistor ST, a liquid crystal capacitor CL and a storage capacitor CST. The switching transistor ST connects the capacitors CL and CST to a corresponding data line DL in response to a gate driving signal transferred through a corresponding gate line GL. The liquid crystal capacitor CL is connected between the switching transistor ST and the common voltage VCOM. The storage capacitor CST is connected between the switching transistor ST and a ground voltage VGND. The liquid crystal capacitor CL may adjust an amount of transmitted light depending on the data stored in the storage capacitor CST.

An artisan should understand and appreciate that the structure of the pixel PXb of FIG. 5B does not limit the example embodiments of the display panel. For example, LCD pixels of various configurations may be utilized for the display panel according to some example embodiments of the inventive concept.

Referring back to FIG. 4, the pixels in the display panel 110 are connected to the source driving circuit 130 through the connection nodes NC1~NCL and to the gate driving circuit 140 through the gate lines GL1~GLm.

The source driving circuit 130 provides data signals to the display panel 110 by providing data signals or data voltages through the data lines connected to the connection nodes NC1~NCL. The gate driving circuit 140 provides gate driving signals through the gate lines GL1~GLm for controlling rows of pixels. The timing controller 120 controls overall operations on the display device 100. The timing controller 120 may provide control signals CONT1 and CONT2 to control the gate driving circuit 140 and the source driving circuit 130, respectively, to control the display panel 110. In an example embodiment, the timing controller 120, the source driving circuit 130 and the gate driving circuit 140 may be implemented as a single integrated circuit (IC). In another example embodiment, the timing controller 120, the source driving circuit 130 and the gate driving circuit 140 may be implemented as two or more ICs.

The gamma voltage generation circuit 150 generates gamma voltages VGREF and provides the gamma voltages VGREF to the source driving circuit 130. The gamma voltages VGREF have voltage levels corresponding to the display data DATA. For example, the gamma voltage generation circuit 150 may include a resistor string circuit such that a plurality of resistors may be coupled in series between a power supply voltage and a ground voltage to provide divided voltages as the gamma voltages VGREF. In an example embodiment, the gamma voltage generation circuit 150 may be included in the source driving circuit 130. The gamma voltage generation circuit 150 may generate gamma voltages VGREF corresponding to respective colors.

Figure 6:
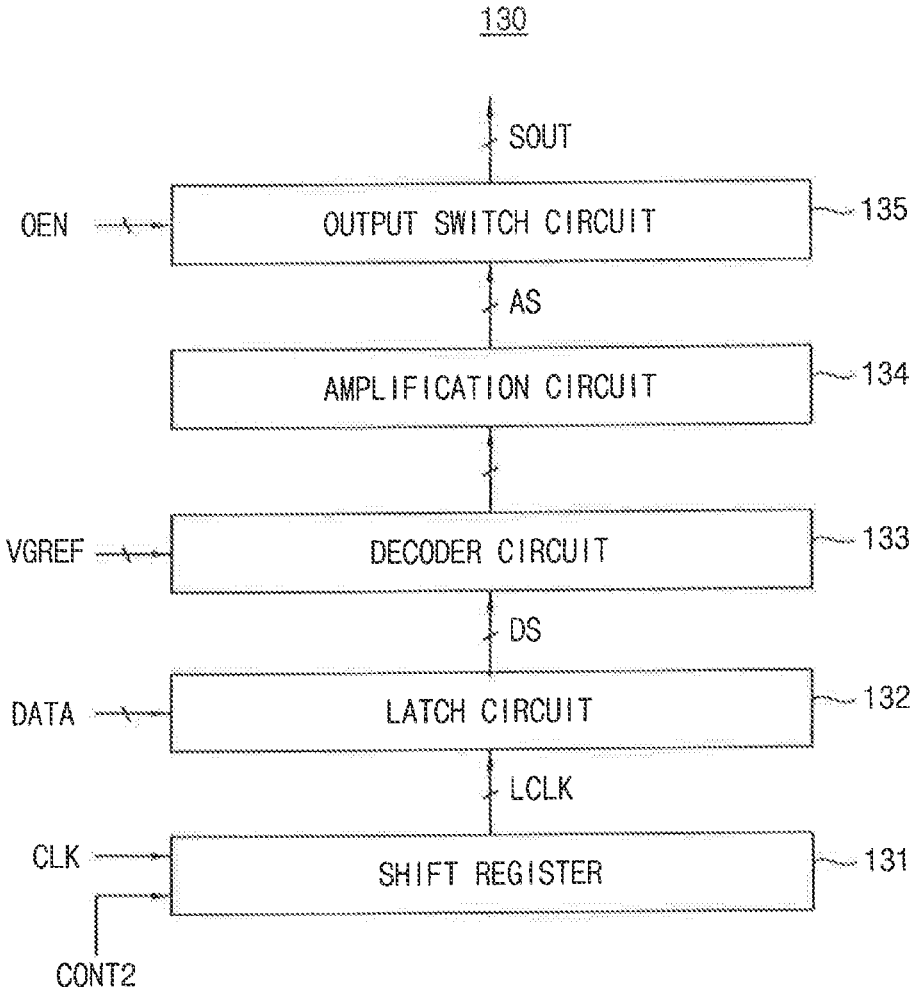
FIG. 6 is a block diagram illustrating a source driving circuit according to example embodiments of the inventive concept.

FIG. 6 is a block diagram illustrating a source driving circuit according to example embodiments of the inventive concept.

Referring to FIG. 6, a source driving circuit 130 may include a shift register 131, a latch circuit 132, a decoder circuit 133, an amplification circuit 134 and an output switch circuit 135. An artisan should understand and appreciate that the embodiments of the inventive concept are not limited to the arranged of circuits shown in FIG. 6 for explanatory purposes.

The shift register 131 may receive a clock signal CLK and a control signal CONT2 from the timing controller 120 in FIG. 4, and may generate a plurality of latch clock signals LCLK based on the clock signal CLK. Each of the latch clock signals LCLK may determine a latch time point of the latch circuit 132 as a clock signal of a specific period.

The latch circuit 132 may store pixel data in response to the latch clock signals LCLK provided by the shift register 131. The latch circuit 132 may output the stored pixel data as a plurality of digital data signals DS to the decoder circuit 133 in response to a control signal from the timing controller 120 in FIG. 4. The decoder circuit 133 may perform an analog conversion operation of the digital data signals DS using gamma voltages VGREF to generate analog data voltages.

The amplification circuit 134 may perform an amplification operation of the data voltages output from the decoder circuit 133 to generate a plurality of amplified analog data signals AS. The output switch circuit 135 may transfer the analog data signals AS alternately to a plurality of connection nodes NC1~NCL connected to the display panel 110 in FIG. 4.

With reference to FIGS. 1 and 2, the decoder circuit 133 may include a plurality of decoders DEC respectively included in a plurality of unit driving circuits, the amplification circuit 134 may include a plurality of amplifiers AMP respectively included in the plurality of unit driving circuits, and the output switch circuit 135 may include a plurality of output switches SWO1-SW0K respectively included in the plurality of unit driving circuits. In addition, as will be described below with reference to FIG. 8, the latch circuit 132 may include a plurality of input switches and a plurality of latches respectively included in the source driving circuits.

Figure 7:
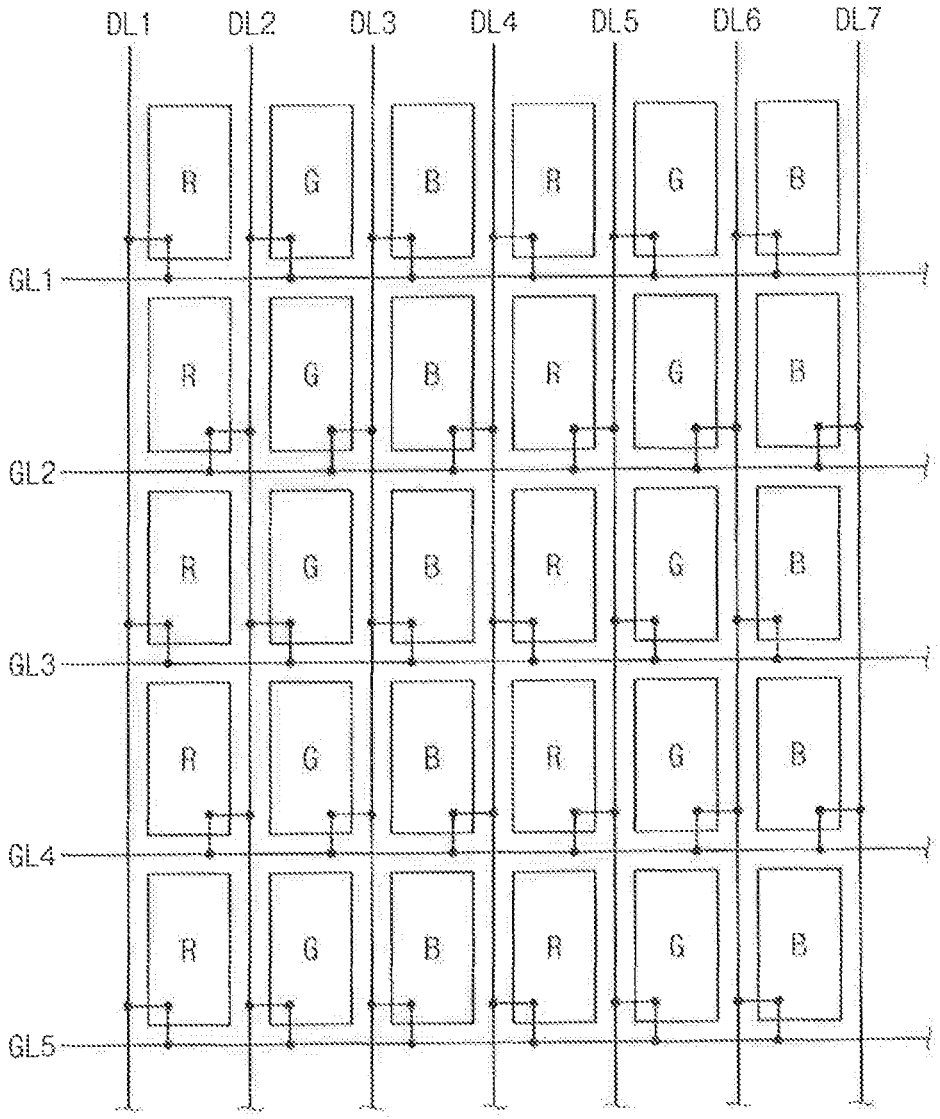
FIG. 7 is a diagram illustrating an example of a pixel layout of a display panel in FIG. 4.

FIG. 7 is a diagram illustrating an example of a pixel layout of a display panel in FIG. 4.

Referring to FIG. 7, a display panel may include a plurality of pixels connected to a plurality of gate lines GL1~GL5 and a plurality of data lines DL1~DL7. The pixels may include, for example, red pixels R, green pixels G and blue pixels. The gate lines extend in a first direction and the data lines DL1~DL7 extend in a second direction perpendicular to the first direction. The pixels may be grouped into a plurality of pixel rows arranged in the second direction or a plurality of pixel columns arranged in the first direction.

As illustrated in FIG. 7, each pixel row may have a structure in which the red pixel R, the green pixel G and the blue pixel B are arranged alternately, which may be referred to as an RGB stripe structure. In one non-limiting example of the RGB stripe structure, six pixels may be driven through one connection node as illustrated in FIG. 8.

Although FIG. 7 illustrates that the pixels in the same pixel row are connected to the same gate line and the pixels in the same pixel column are connected to the same data line, an artisan should understand and appreciate that example embodiments are not limited thereto. In some example embodiments, the pixels in the adjacent pixel rows may be connected to the same gate line in a zigzag pattern and/or the pixels in the adjacent pixel columns may be connected to the same data line in a zigzag pattern.

Figure 8:
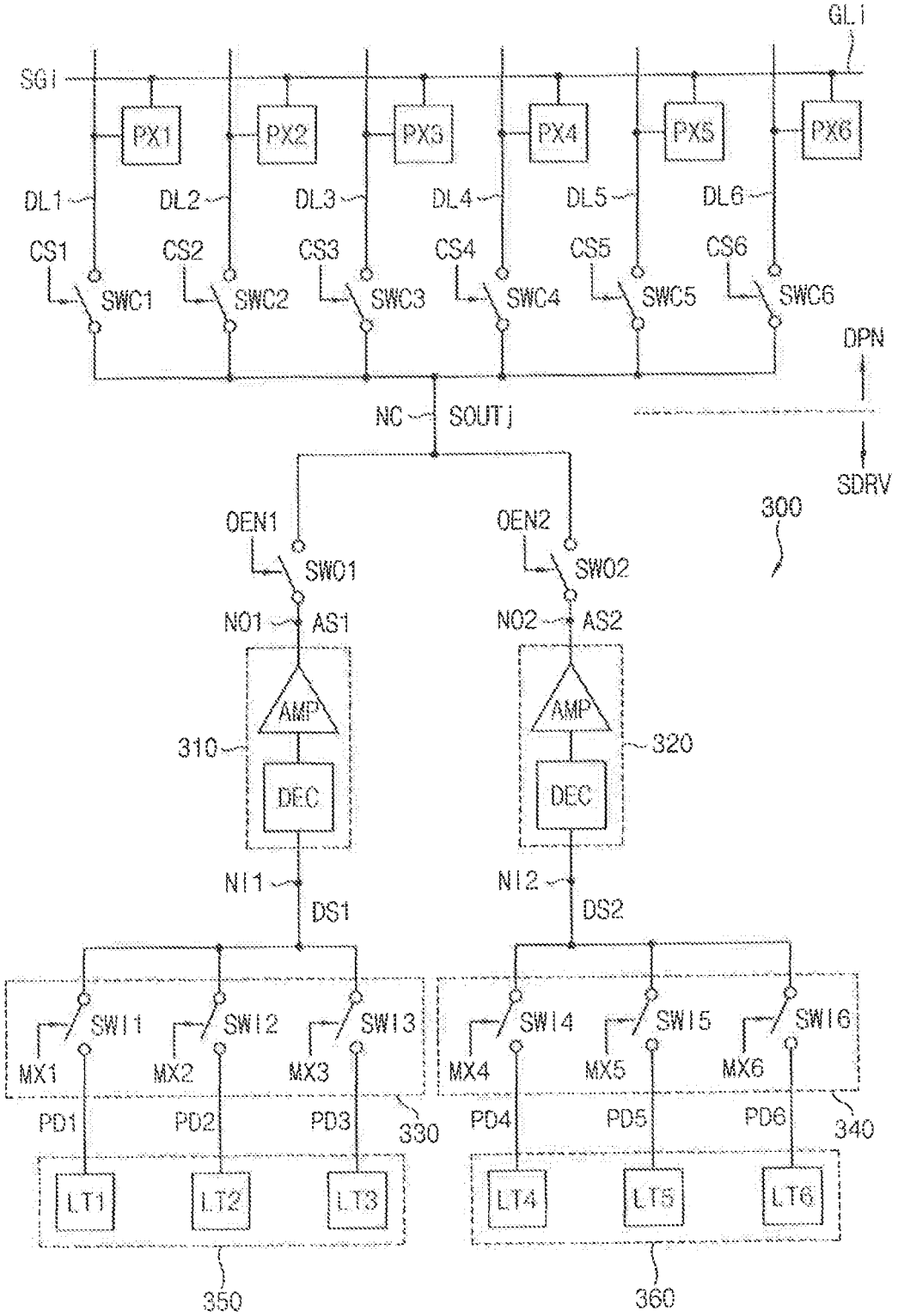
FIG. 8 is a diagram illustrating an example embodiment of a unit driving circuit corresponding to the pixel layout of FIG. 7.

FIG. 8 is a diagram illustrating an example embodiment of a unit driving circuit corresponding to the pixel layout of FIG. 7.

An example embodiment of a unit driving circuit 300 included in a source driving circuit SDRV to drive a connection node NC is illustrated in a lower portion of FIG. 8, and an example embodiment of a configuration corresponding to six data lines, for example, first through sixth data lines DL1~DL6 included in a display panel DPN are illustrated in an upper portion of FIG. 8.

Referring to FIG. 8, first through sixth column switches SWC1~SWC6 may be connected in parallel between the connection node NC and the first through sixth data lines DL1~DL6. The first through sixth column switches SWC1~SWC6 may perform switching operations in response to the first through sixth column selection signals CS1~CS6, respectively. As will be described below with reference to FIG. 9, the first through sixth column selection signals CS1~CS6 may be activated alternately one by one and thus the first through sixth column switches SWC1~SWC6 may be turned on alternately one by one. The data voltage, or the pixel data of the output signal SOUTj provided through the connection node NC may be applied to the corresponding data line through the turned-on column switch.

For ease of illustration, FIG. 8 illustrates only the first through sixth pixels PX1~PX6 that are connected to a gate line GLi corresponding to an activated gate signal SGi. For example, the first and fourth pixels PX1 and PX4 may be red pixels R, the second and fifth pixels PX2 and PX5 may be green pixels G and the third and sixth pixels PX3 and PX6 may be blue pixels, as described with reference to FIG. 7.

The unit driving circuit 300 may include a first driver circuit 310, a second driver circuit 320, a first output switch SWO1, a second output switch SWO2, a first input switch group 330, a second input switch group 340, a first latch group 350 and a second latch group 360.

The first driver circuit 310 performs analog-conversion and amplification operations on a first digital data signal DS1 received through a first input node NI1 to generate a first analog data signal AS1 through a first output node NO11. The second driver circuit 320 performs analog-conversion and amplification operations on a second digital data signal DS2 received through a second input node NI2 to generate a second analog data signal AS2 through a second output node NO2.

The first output switch SWO1 is connected to the first output node NO1 and a connection node NC that is connected to the display panel DPN. The second output switch SWO2 is connected to the second output node NO2 and the connection node NC. For example, the first output switch SWO1 and the second output switch SWO2 are connected in parallel between the connection node NC and the first driver circuit 310 and the second driver circuit 320.

Each of the first driver circuit 310 and the second driver circuit 320 includes a decoder DEC and a source amplifier AMP. The decoder DEC may receive the gamma voltages VGREF from the gamma voltage generation circuit 150 in FIG. 4 and the digital data signals DS1 and DS2 through the first input switch group 330 and the second input switch group 340. Each of the digital data signals DS1 and DS2 may include pixel data corresponding to pixels in the display panel DPN. The decoder DEC may output one of the gamma voltages based on the received pixel data. The source amplifier AMP may amplify a voltage from the decoder DEC to generate each of the analog data signals AS1 and AS2. The decoder DEC and the source amplifier AMP may be implemented in various configurations.

The first output switch SWO1 may perform a switching operation in response to a first output enable signal OEN1, and the second output switch SWO2 may perform a switching operation in response to a second output enable signal OEN2. As will be described below with reference to FIG. 9, the first output enable signal OEN1 and the second output signal OEN2 may be alternately activated, and thus the first output switch SWO1 and the second output switch SWO2 may be alternately turned on. In other words, the unit driving circuit 300 may provide the first analog data signal AS1 and the second analog data signal AS2 alternately as an output signal SOUTj to drive the connection node NC.

The first input switch group 330 may include first, second and third input switches SWI1, SWI2 and SWI3, and the second input switch group 340 may include fourth, fifth and sixth input switches SWI4, SWI5 and SWI6. The first through sixth input switches SWI1~SWI6 may perform switching operations with respect to the first through sixth input selection signals MX1~MX6, respectively. The first latch group 350 may include first, second and third latches LT1, LT2 and LT3, and the second latch group 360 may include fourth, fifth and sixth latches LT4, LT5 and LT6.

The input switches SWI1, SWI2 and SWI3 of the first input switch group 330 are commonly connected to the first input node NI1 and outputs a first group of pixel data PD1, PD2 and PD3 as the first digital data signal DS1 to the first input node NI1 where the first group of pixel data PD1, PD2 and PD3 are for driving a first group of pixels PX1, PX2 and PX3 that are connected to the same gate line GLi of the display panel DPN. The input switches SWI4, SWI5 and SWI6 of the second input switch group 340 are commonly connected to the second input node NI2 and outputs a second group of pixel data PD4, PD5 and PD6 as the second digital data signal DS2 to the second input node NI2 where the second group of pixel data PD4, PD5 and PD6 are provided for driving a second group of pixels PX4, PX5 and PX6 that are connected to the same gate line GLi.

Accordingly, a plurality of input switches SWI1~SWI6 may be grouped into a plurality of first input switch group 330 and second input switch group 340 that provide a plurality of digital data signals DS1 and DS2, respectively. In addition, a plurality of latches LT1~LT6 may be grouped into a plurality of the first latch group 350 and the second latch group 360 that provide the pixel data PD1~PD6 of the digital data signals DS1 and DS2, respectively.

As will be described below with reference to FIG. 9, the first through third input selection signals MX1~MX3 may be activated alternately, and thus the first through third input switches SWI1~SWI3 may be alternately turned on. Accordingly, the first through third pixel data PD1~PD3 latched by the first through third latches LT1~LT3 may be provided to the first driver circuit 310 as the first digital data signal DS1. In addition, the fourth through sixth input selection signals MX4~MX6 may be alternately activated, and thus the fourth through sixth input switches SWI4~SWI6 may be alternately turned on. Accordingly, the fourth through sixth pixel data PD4~PD6 latched by the fourth through sixth latches LT4~LT6 may be provided to the second driver circuit 320 as the second digital data signal DS2.

Figure 9:
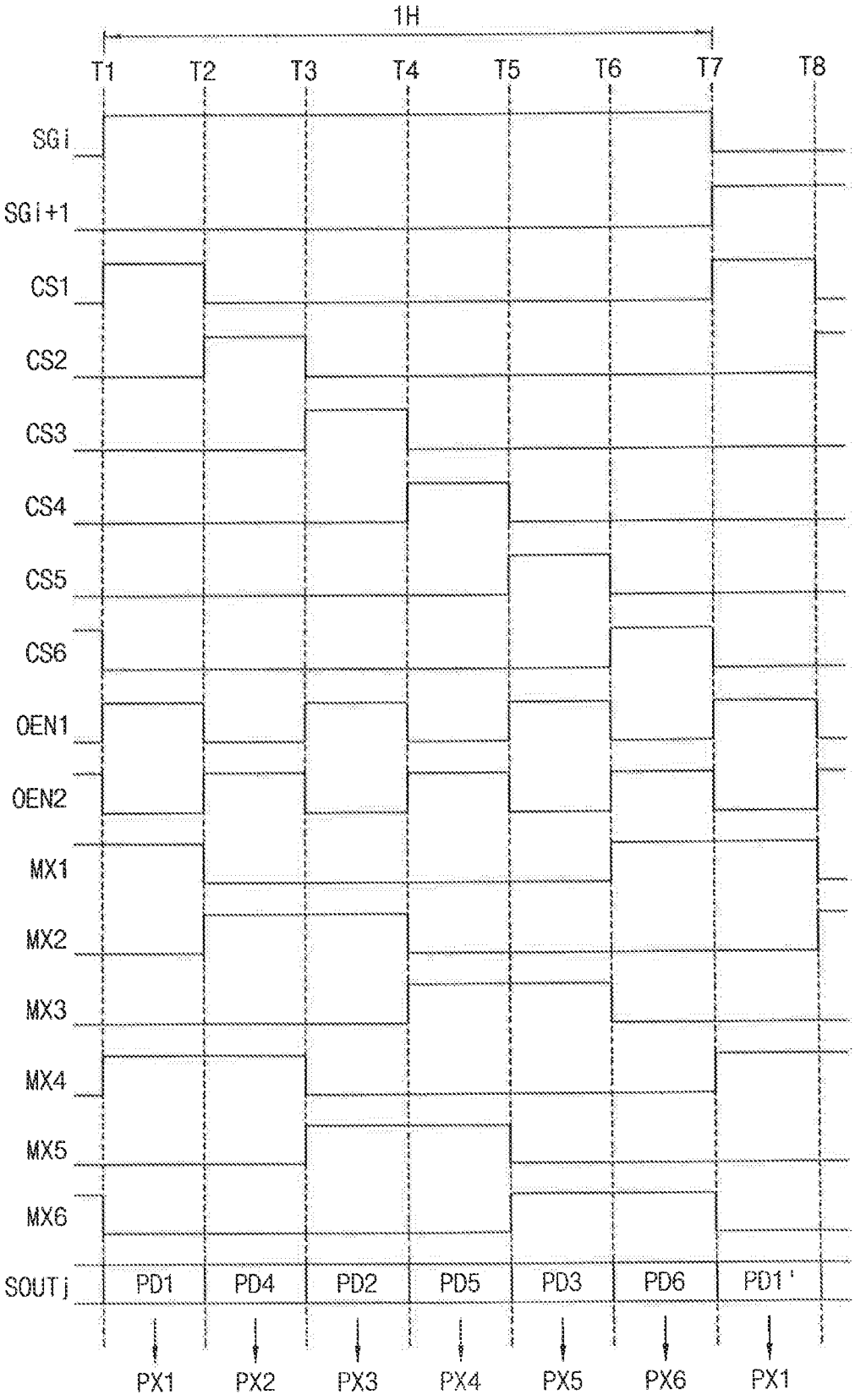
FIG. 9 is a timing diagram illustrating an operation of the unit driving circuit of FIG. 8.

FIG. 9 is a timing diagram illustrating an operation of the unit driving circuit of FIG. 8.

FIG. 9 illustrates an operation corresponding to an activation time interval of a gate signal SGi applied to a selected gate line GLi, for example, for one horizontal period 1H. The same operation will be performed during the horizontal period 1H corresponding to the next gate signal Sgi+1, and in this way the driving operation may be repeated with respect to all rows of the display panel DPN.

Referring to FIGS. 8 and 9, the first through sixth column selection signals CS1~CS6 may be alternately activated at time points T1~T8. In response to such column selection signals CS1~CS6, the first through sixth column switches SWC1~SWC6 may be alternately turned on one-by-one.

The first output enable signal OEN1 and the second output enable signal OEN2 may toggle or be activated alternately at time points T1~T8. The first output switch SWO1 and the second output switch SWO2 may be alternately turned on in response to the first output enable signal OEN1 and the second output enable signal OEN2.

The first, second and third input switches SWI1, SWI2 and SWI3 in the first input switch group 330 are turned on sequentially at the time points T2, T4 and T6 when the second output enable signal OEN2 is activated. The fourth, fifth and sixth input switches SWI4, SWI5 and SWI6 in the second input switch group 340 are sequentially turned on at the time points T1, T3 and T5 when the first output enable signal OEN1 is activated.

The first digital data signal DS1 and the second digital data signal DS2 may include pixel data PD1~PD8 corresponding to pixels included in the display panel, respectively. For example, the first input switch SWI1, the second input switch SWI2, and the third input switch SWI3 may be turned on in sequence such that the first digital data signal DS1 may sequentially include the first, second and third pixel data PD1, PD2 and PD3, and the fourth input switch SWI4, the fifth input switch SWI5, and the sixth input switch SWI6 may be turned on in sequence such that the second digital data signal DS2 may sequentially include the fourth, fifth and sixth pixel data PD4, PD5 and PD6. The data changing time points of the first digital data signal DS1 correspond to the activation time points of the first, second and third input selection signals MX1, MX2 and MX3, for example, the activation time points T2, T4, T6 and T8 of the second output enable signal OEN2. In addition, the data changing time points of the second digital signal DS2 correspond to the activation time points of the fourth, fifth and sixth input selection signals MX4, MX5 and MX6, for example, the activation time points T1, T3, T5 and T7 of the first output enable signal OEN1.

The first driver circuit 310 performs analog-conversion and amplification operations on the first digital data signal DS1 to generate the first analog data signal AS1. The second driver circuit 320 performs analog-conversion and amplification operations on the second digital signal DS2 to generate the second analog data signal AS2.

Each of the first driver circuit 310 and the second driver circuit 320 receives a corresponding digital data signal among the first and second digital data signals DS1 and DS2 to generate a corresponding analog data signal among the first and second analog data signals AS1 and AS2 in advance before transferring the corresponding analog data signal to the corresponding connection node NC. In other words, each input switch is turned on to provide one pixel data through the corresponding digital data signal to the corresponding driver circuit before the output switch connected to the corresponding driver circuit is turned on to transfer the analog data signal corresponding to the one pixel data to the corresponding connection node. Such an operation reduces the source settling time because the first driver circuit 310 and the second driver circuit 320 may generate the corresponding analog data in advance of transferring the corresponding analog data signal to the corresponding connection node NC.

For such operation, there are two input switches included in the first input switch group 330 and the second input switch group 340, respectively, that have a time interval during which the two input switches are turned on simultaneously. For example, the first input switch SWI1 of the first input switch group 330 and the fourth input switch SWI4 of the second input switch group 340 may be turned on simultaneously during the time interval T1~T2 while the first input selection signal MX1 and the fourth input selection signal MX4 are activated simultaneously.

For example, as described with reference to FIG. 3, the first driver circuit 310 may receive the second pixel data PD2 in advance at the second time point T2 when the second input selection signal MX2 is activated to perform the analog-conversion and amplification operations on the second pixel data PD2 and the first driver circuit 310 may stabilize the first analog data signal AS1 to a voltage level corresponding to the second pixel data PD2 after the delay time tD. After that, at the third time point T3 when the first output enable signal OEN1 is activated, the first output switch SWO1 is turned on and voltage corresponding to the second data PD2 may be output as the output signal SOUTj promptly to the connection node NC.

According to sequential activation of the input selection signals MX1~MX6 and the output enable signals OEN1 and OEN2, the output signal SOUTj may include the pixel data PD1, PD4, PD2, PD5, PD3, PD6 and PD1' in that order. If the first through sixth column selection signals CS1~CS6 are activated sequentially, the pixel data in the output signal SOUTj may be provided sequentially to the first through sixth pixels PX1~PX6.

Accordingly, the source driving circuit and the display device including the source driving circuit according to example embodiments of the inventive concept may reduce the source settling time efficiently by performing the analog-conversion and amplification operations on one pixel data using one unit driving circuit while another unit driving circuit outputs an analog data signal corresponding to other pixel data to the connection node.

Figure 10:
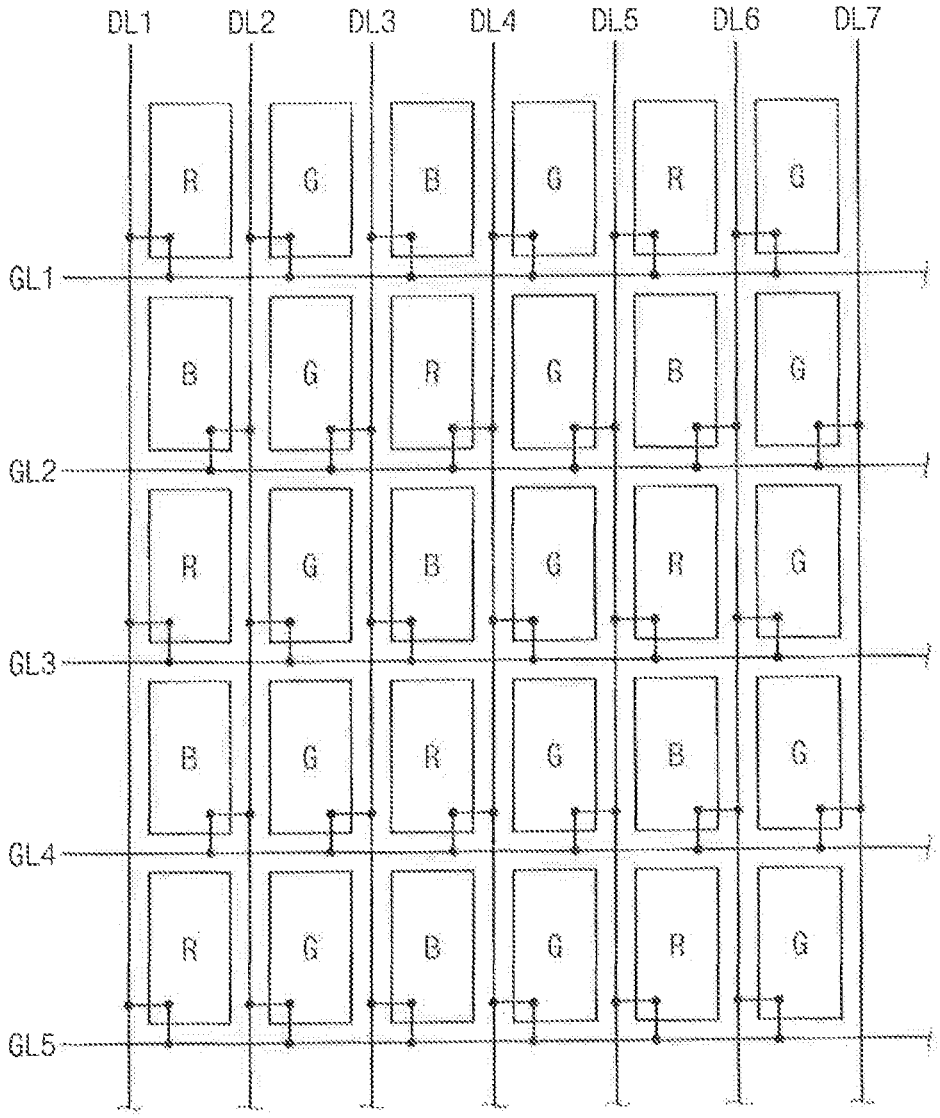
FIG. 10 is a diagram illustrating an example of a pixel layout of a display panel in FIG. 4.

FIG. 10 is a diagram illustrating an example of a pixel layout of a display panel shown in FIG. 4.

Referring to FIG. 10, a display panel may include a plurality of pixels connected to a plurality of gate lines GL1~GL5 and a plurality of data lines DL1~DL7. The pixels may include red pixels R, green pixels G and blue pixels. The gate lines extend in a first direction and the data lines DL1~DL7 extend in a second direction perpendicular to the first direction. The pixels may be grouped into a plurality of pixel rows arranged in the second direction or a plurality of pixel columns arranged in the first direction.

As illustrated in FIG. 10, each pixel row may have a structure in which RG pixel pairs and BG pixel pairs are arranged alternately, which may be referred to as a pentile structure. In the pentile structure, four pixels may be driven through one connection node as illustrated in FIG. 11.

Figure 11:
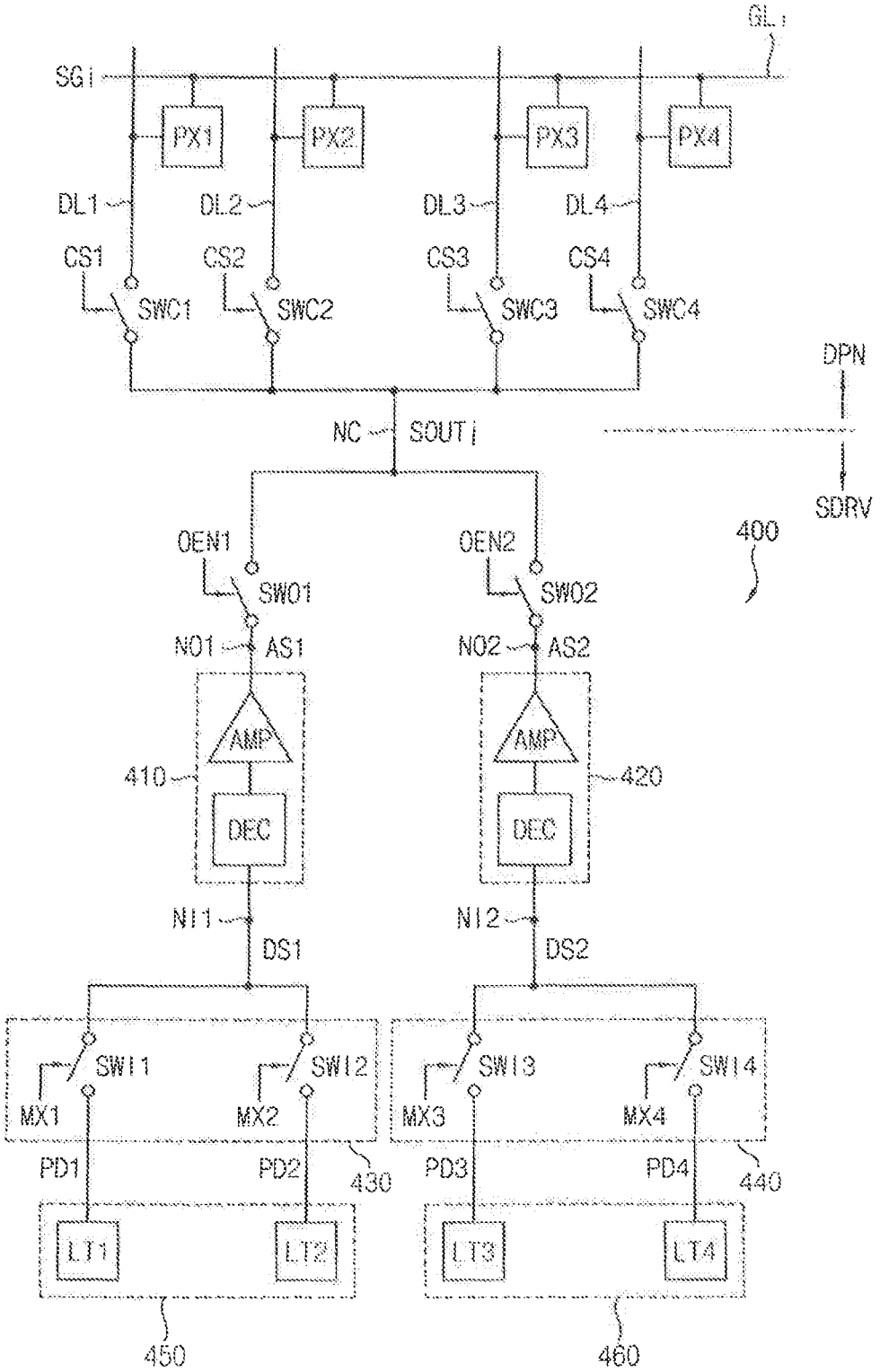
FIG. 11 is a diagram illustrating an example embodiment of a unit driving circuit corresponding to the pixel layout of FIG. 10.
Figure 12:
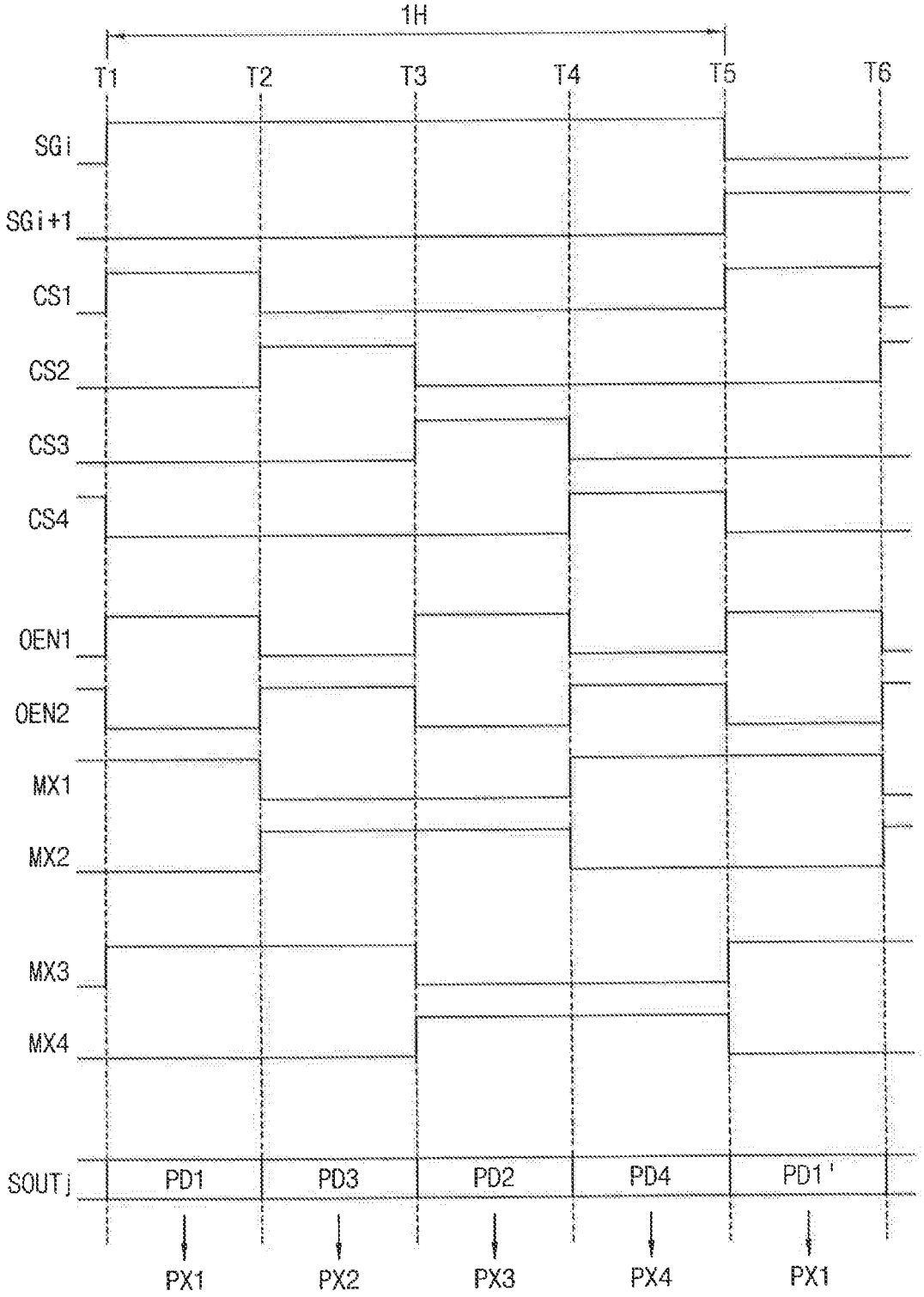
FIG. 12 is a timing diagram illustrating an operation of the unit driving circuit of FIG. 11.

FIG. 11 is a diagram illustrating an example embodiment of a unit driving circuit corresponding to the pixel layout of FIG. 10, and FIG. 12 is a timing diagram illustrating an operation of the unit driving circuit of FIG. 11. Hereinafter, some of the description of these figures that would be a repeat of part of the description of FIGS. 8 and 9 may be omitted.

An example embodiment of a unit driving circuit 400 included in a source driving circuit SDRV to drive a connection node NC is illustrated in a lower portion of FIG. 11, and an example embodiment of a configuration corresponding to four data lines, that is, first through fourth data lines DL1~DL4 included in a display panel DPN is illustrated in an upper portion of FIG. 11.

Referring to FIG. 11, first through fourth column switches SWC1~SWC4 may be connected in parallel between the connection node NC and the first through fourth data lines DL1~DL4. The first through fourth column switches SWC1~SWC4 may perform switching operations in response to first through fourth column selection signals CS1~CS4, respectively. As will be described below with reference to FIG. 12, the first through fourth column selection signals CS1~CS4 may be alternately activated one-by-one, and thus the first through fourth column switches SWC1~SWC4 may be alternately turned on one-by-one. The data voltage or the pixel data of the output signal SOUTj provided through the connection node NC may be applied to the corresponding data line through the turned-on column switch.

For ease of illustration, FIG. 11 illustrates only the first through fourth pixels PX1~PX4 that are connected to a gate line GLi corresponding to an activated gate signal SGi. For example, the first and fourth pixels PX1 and PX2 may be the RG pixel pair and the third and fourth pixels PX3 and PX4 may be the BG pixel pair, as described with reference to FIG. 10.

The unit driving circuit 400 may include a first driver circuit 410, a second driver circuit 420, a first output switch SWO1, a second output switch SWO2, a first input switch group 430, a second input switch group 440, a first latch group 450 and a second latch group 460.

The first driver circuit 410 performs analog-conversion and amplification operations on a first digital data signal DS1 received through a first input node NI1 to generate a first analog data signal AS1 through a first output node NO1. The second driver circuit 420 performs analog-conversion and amplification operations on a second digital data signal DS2 received through a second input node NI2 to generate a second analog data signal AS2 through a second output node NO2.

The first output switch SWO1 is connected to the first output node NO1 and a connection node NC that is connected to the display panel DPN. The second output switch SWO2 is connected to the second output node NO2 and the connection node NC. For example, the first output switch SWO1 and the second output switch SWO2 are connected in parallel between the connection node NC and the first driver circuit 410 and the second driver circuit 420.

Each of the first driver circuit 410 and the second driver circuit 420 includes a decoder DEC and a source amplifier AMP. The decoder DEC may receive the gamma voltages VGREF from the gamma voltage generation circuit 150 in FIG. 4 and the digital data signals DS1 and DS2 through the first and second input switch groups 330 and 340. Each of the digital data signals DS1 and DS2 may include pixel data corresponding to pixels in the display panel DPN. The decoder DEC may output one of the gamma voltages based on the received pixel data. The source amplifier AMP may amplify a voltage from the decoder DEC to generate each of the analog data signals AS1 and AS2. The decoder DEC and the source amplifier AMP may be implemented with various configurations.

The first output switch SWO1 may perform a switching operation in response to a first output enable signal OEN1, and the second output switch SWO2 may perform a switching operation in response to a second output enable signal OEN2. As will be described below with reference to FIG. 12, the first output enable signal OEN1 and the second output signal OEN2 may be alternately activated, and thus the first output switch SWO1 and the second output switch SWO2 may be alternately turned on. In other words, the unit driving circuit 400 may provide the first analog data signal AS1 and the second analog data signal AS2 alternately as an output signal SOUTj to drive the connection node NC.

The first input switch group 430 may include the first input switch SWI1 and the second input switch SWI2, and the second input switch group 440 may include third input switch SWI3 and fourth input switch SWI4. The first through fourth input switches SWI1~SWI4 perform switching operations in respect to the first through fourth input selection signals MX1~MX4, respectively. The first latch group 450 may include first and second latches LT1 and LT2, and the second latch group 460 may include third and fourth latches LT3 and LT4.

The first input switch SWI1 and the second input switch SWI2 of the first input switch group 430 are commonly connected to the first input node NI1, and outputs a first group of pixel data PD1 and PD2 as the first digital data signal DS1 to the first input node NI1 where the first group of pixel data PD1 and PD2 are used to drive a first group of pixels PX1 and PX2 that are connected to the same gate line GLi of the display panel DPN. The third input switch SWI3 and the fourth input switch SWI4 of the second input switch group 440 are commonly connected to the second input node NI2 and outputs a second group of pixel data PD3 and PD4 as the second digital data signal DS2 to the second input node NI2 where the second group of pixel data PD3 and PD4 are for driving a second group of pixels PX3 and PX4 that are connected to the same gate line GLi.

As such, a plurality of input switches SWI1~SWI4 may be arranged into a plurality of input switch groups 430 and 440 that provide a plurality of digital data signals DS1 and DS2, respectively. In the same way, a plurality of latches LT1~LT4 may be arranged into a plurality of first latch group 450 and second latch 460 that provide the pixel data PD1~PD4 of the digital data signals DS1 and DS2, respectively.

As illustrated in FIG. 12, the first and second input selection signals MX1 and MX2 may be alternately activated, and thus the first and second input switches SWI1 and SWI2 may be alternately turned on. Accordingly the first and second pixel data PD1 and PD2 latched by the first and second latches LT1 and LT2 may be provided to the first driver circuit 410 as the first digital data signal DS1. In addition, the third and fourth input selection signals MX3 and MX4 may be alternately activated, and thus the third input switch SWI3, and the fourth input switch SWI4 may be alternately turned on. Accordingly, the third and fourth pixel data PD3 and PD4 latched by the third and fourth latches LT3 and LT4 may be provided to the second driver circuit 420 as the second digital data signal DS2.

According to sequential activation of the input selection signals MX1~MX4 and the output enable signals OEN1 and OEN2, the output signal SOUTj may include the pixel data PD1, PD3, PD2, PD4 and PD1' in that order. If the first through fourth column selection signals CS1~~CS4 are activated in sequence, the pixel data in the output signal SOUTj may be provided in sequence to the first through fourth pixels PX1~PX4.

Accordingly, the source driving circuit and the display device including the source driving circuit according to example embodiments of the inventive concept may reduce the source settling time efficiently by performing the analog-conversion and amplification operations on one pixel data using one unit driving circuit while another unit driving circuit outputs an analog data signal corresponding to other pixel data to the connection node.

The example embodiment of FIGS. 8 and 9, or the example embodiment of FIGS. 11 and 12 may be adopted selectively depending on the pixel arrangement structure of the display panel. In case of the RGB stripe structure of FIG. 7, each input switch group may include, for example, three input switches and six column switches, and in this example, six data lines may be connected to each connection node. In case of the pentile structure of FIG. 10, each input switch group may include two input switches and four column switches, and four data lines may be connected to each connection node.

Figure 13:
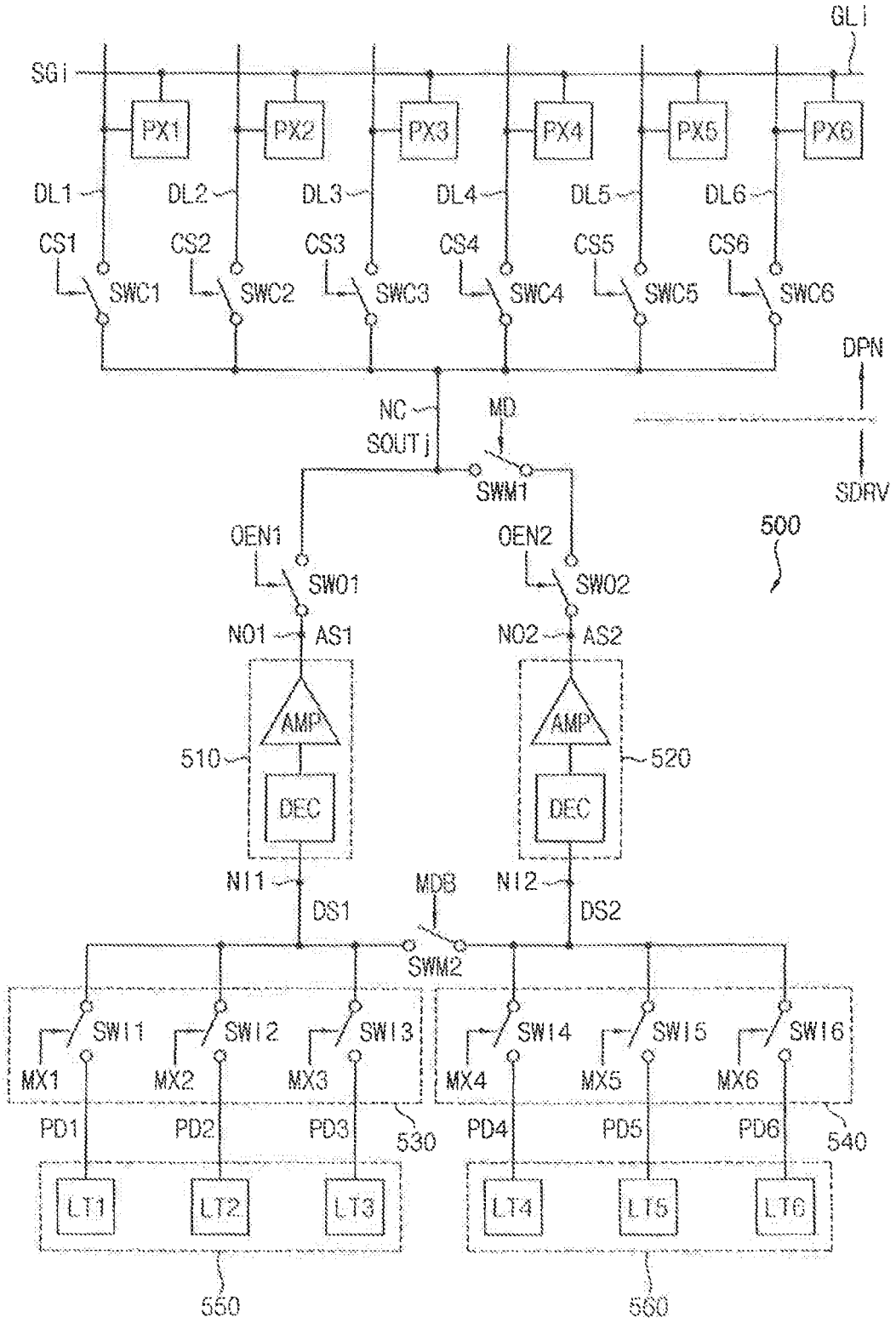
FIG. 13 is a diagram illustrating an example embodiment of a unit driving circuit corresponding to the pixel layout of FIG. 7.
Figure 14:
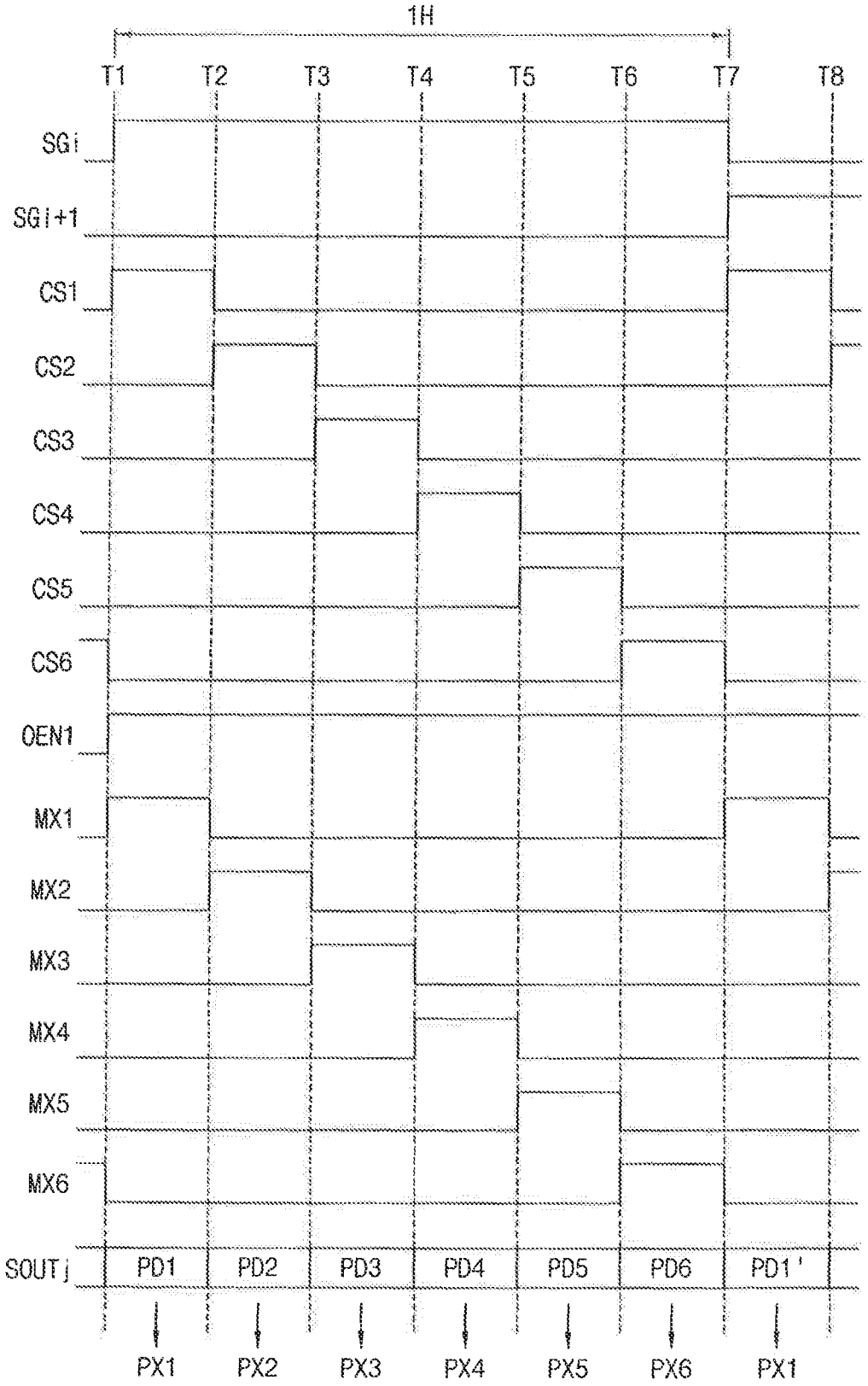
FIG. 14 is a timing diagram illustrating an operation of the unit driving circuit of FIG. 13.

FIG. 13 is a diagram illustrating an example embodiment of a unit driving circuit corresponding to the pixel layout of FIG. 7, FIG. 14 is a timing diagram illustrating an operation of the unit driving circuit of FIG. 13. Hereinafter, the description already discussed with regard to FIGS. 8 and 9 may be omitted from the discussion of FIG. 13 and FIG. 14.

A unit driving circuit 500 of FIG. 13 may include a first driver circuit 510, a second driver circuit 520, a first output switch SWO1, a second output switch SWO2, a first input switch group 530, a second input switch group 540, a first latch group 550, a second latch group 560, a first mode switch SWM1 and a second mode switch SWM2. The unit driving circuit 500 of FIG. 13 is substantially the same as the unit driving circuit 300 of FIG. 8, except for the first and second mode switches SWM1 and SWM2.

The first mode switch SWM1 is connected between the connection node NC and the second output switch SWO2. In other example embodiments of the inventive concept, the first mode switch signal SWM1 may be connected between the connection node NC and the first output switch SWO1. The second mode switch SWM2 is connected between the first input node NI1 and the second input node NI2. The first mode switch SWM1 and the second mode switch SWM2 may be turned on in response to a mode signal MD and an inversion mode signal MDB, respectively.

In a first operation mode, the first mode switch SWM1 may be turned on and the second mode switch SWM2 may be turned off. In this case, the unit driving circuit 500 may be the same as the unit driving circuit 300 of FIG. 8 and thus the unit driving circuit 500 may operate as described with reference to FIG. 9.

In a second operation mode, the first mode switch SWM1 may be turned off and the second mode switch SWM2 may be turned on. As a result, one driver circuit, for example, the first driver circuit 510, may drive the six data lines DL1~DL6 in the second operation mode, as illustrated in FIG. 14.

In the second operation mode, the first output enable signal OEN1 may maintain the activated state as illustrated in FIG. 14. The second output enable signal OEN2 may maintain the deactivated state and the driver circuit 520 may be disabled.

The first through sixth input switches SWI1~SWI6 operate as one group in the second operation mode, and also the first through sixth latches LT1~LT6 may operate as one group. Accordingly the first through sixth input selection signals MX1~MX6 may be activated in sequence and the output signal SOUTj may include the pixel data PD1, PD2, PD3, PD4, PD5, PD6 and PD1' in that order. If the first through sixth column selection signals CS1~CS6 are activated in sequence, the pixel data in the output signal SOUTj may be provided sequentially to the first through sixth pixels PX1~PX6.

Accordingly, using the mode switches SWM1 and SWM2, the two driver circuits may drive each connection node in the first operation mode and one driver circuit may drive each connection node in the second operation mode.

Figure 15:
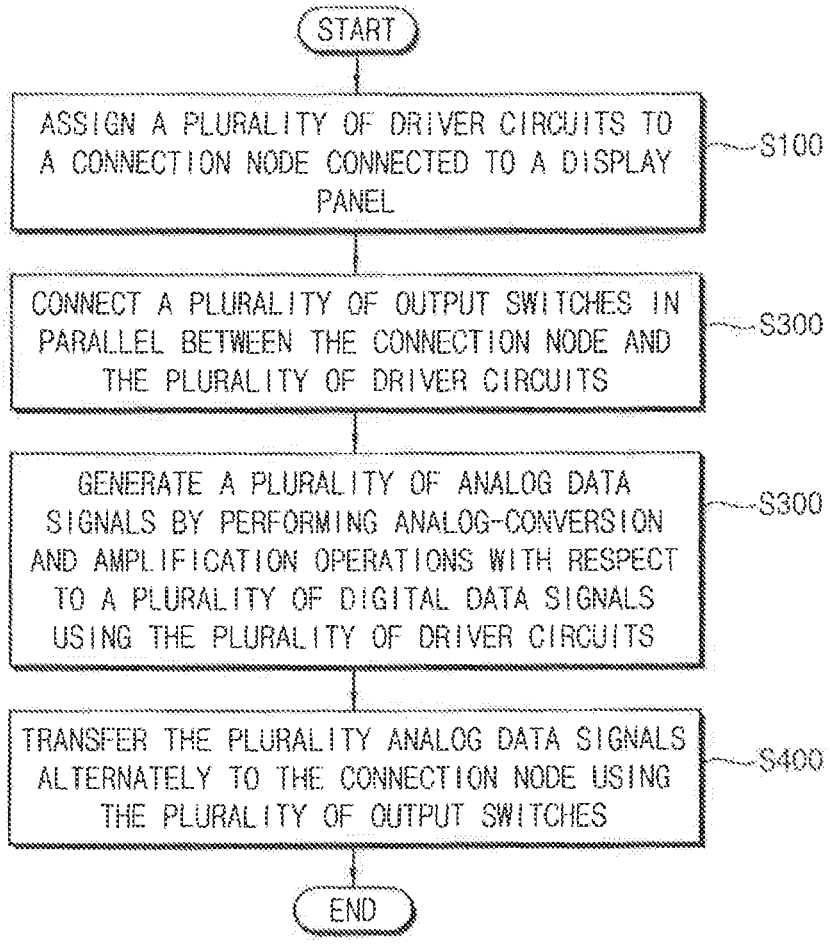
FIG. 15 is a flowchart illustrating a method of driving a display device according to example embodiments of the inventive concept.

FIG. 15 is a flowchart illustrating a method of driving a display device according to example embodiments of the inventive concept.

Referring to FIG. 15, at operation (S100), a plurality of driver circuits are assigned to a connection node connected to a display panel.

At operation (S200) a plurality of output switches are connected in parallel between the connection node and the plurality of driver circuits. At operation (S300), a plurality of analog data signals are generated by performing analog-conversion and amplification operations with respect to a plurality of digital data signals using the plurality of driver circuits. At operation (S400), the plurality analog data signals are transferred alternately to the connection node using the plurality of output switches.

Figure 16:
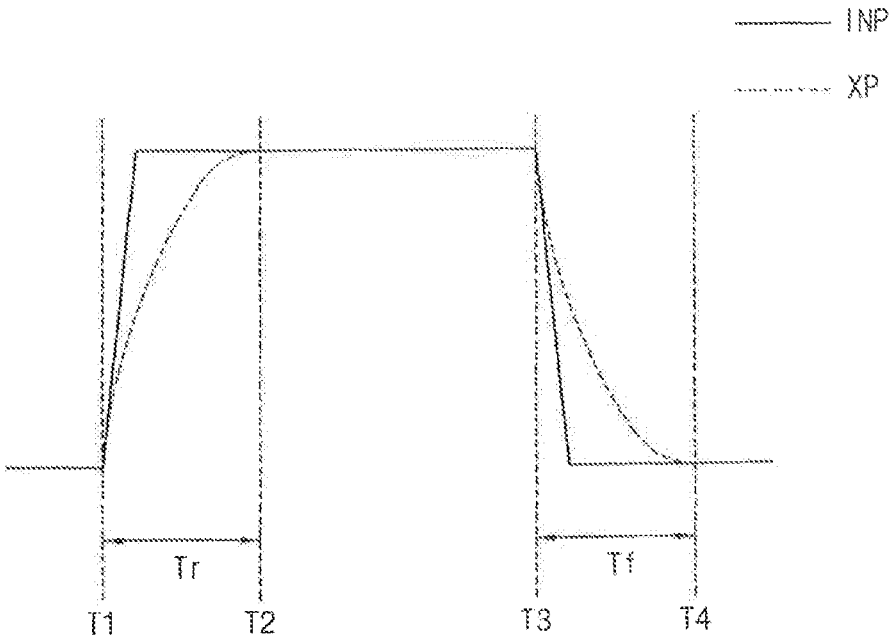
FIG. 16 is a waveform diagram for describing a source settling time of a source driving circuit.

FIG. 16 is a waveform diagram for describing a source settling time of a source driving circuit, and FIGS. 17A, 17B, 17C and 18 are diagrams for describing reduction of a source settling time according to example embodiments.

FIG. 16 illustrates a voltage waveform at a probe position XP with respect to an input signal INP. A rising settling time Tr and a falling settling time Tf are increased as a load to the probe position XP of the input signal INP is increased.

Figure 17A:
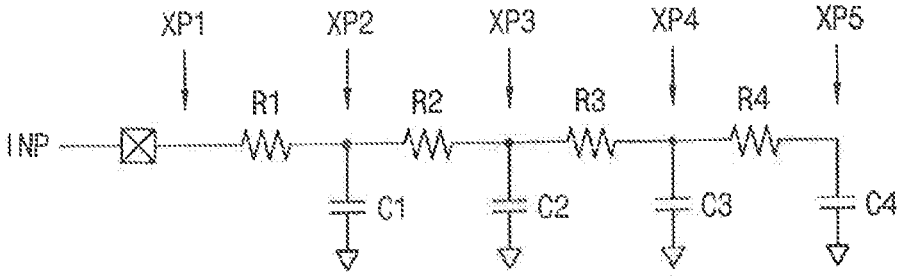
Figure 17B:
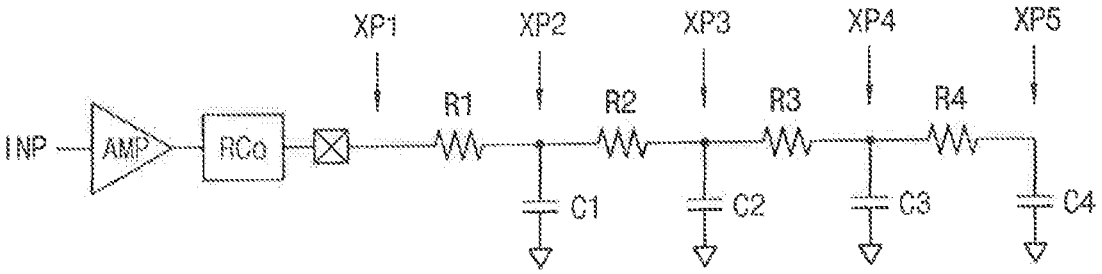
Figure 17C:
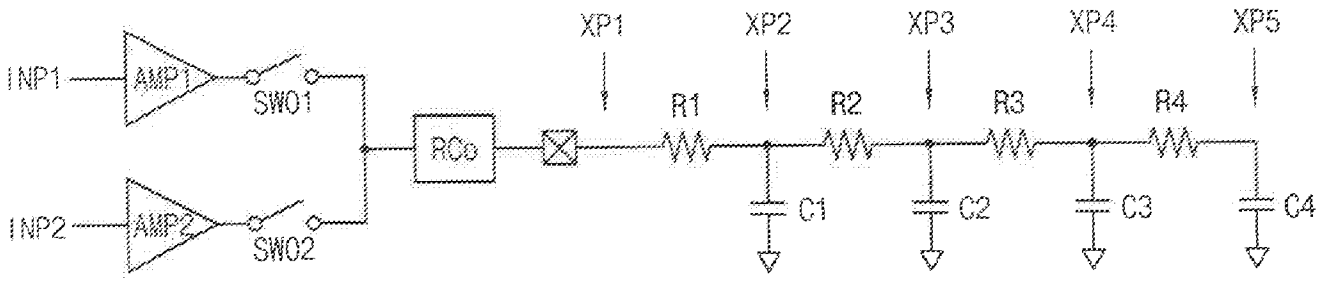

FIG. 17A illustrates an ideal signal transfer path. FIG. 17A illustrates the existence of resistive loads R1~R4 and capacitive loads C1~C4 along a plurality of probe positions XP1~XP5. The rising settling time Tr and the falling settling time Tf are increased as the probe position is far from the applying position of the input signal INP. FIG. 17B illustrates the second operation mode that each connection node is driven with the input signal INP using one amplifier AMP as described with reference to FIGS. 13 and 14, FIG. 17C illustrates the first operation mode that each connection node is driven with input signals INP1 and INP2 using two amplifiers AMP1 and AMP2 as described with reference to FIGS. 7 through 9. RCO indicates an internal load.

FIG. 16 illustrates simulation results of the rising settling time Tr and the falling settling time Tf in microseconds (us) at first through fifth probe positions, with respect to a first case CASE1 corresponding to FIG. 17A, a second case CASE2 corresponding to FIG. 17B and a third case CASE3 corresponding to FIG. 17C. If a source settling time is set to be within 9 us, the second case CASE2 cannot satisfy the parameters (SPEC OUT) at the fourth and fifth probe positions XP4 and XP5. In contrast, the third case CASE3 satisfies the parameters (SPEC IN) at all of the probe positions XP1~XP5.

The source driving circuit and the display device including the source driving circuit according to example embodiments of the inventive concept may reduce the source settling time and enhance performance of the display device by disposing a plurality of unit driving circuits to each connection node.

Figure 19:
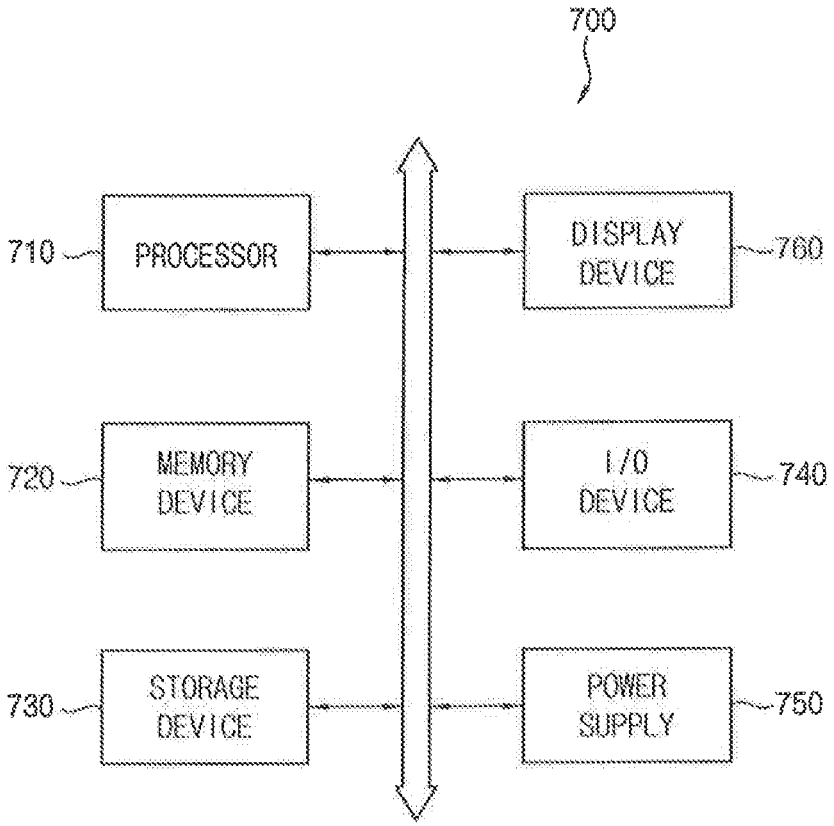
FIG. 19 is a block diagram illustrating a system according to example embodiments of the inventive concept.

FIG. 19 is a block diagram illustrating a system according to example embodiments of the inventive concept.

Referring to FIG. 19, a system 700 includes a processor 710, a memory device 720, a storage device 730, an input/output (I/O) device 740, a power supply 750, and a display device 760. The processor 710 may perform various computing functions or tasks. The processor 710 may be any processing unit such as a microprocessor or a central processing unit (CPU), or an ARM-based processor. The processor 710 may be connected to other components via an address bus, a control bus, a data bus, or the like. Further, the processor 710 may be coupled to an extended bus such as a peripheral component interconnection (PCI) bus.

The memory device 720 and the storage device 730 may store data for operations on the system 700. The I/O device 740 may be, for example, an input device such as a keyboard, a keypad, a mouse, a touch screen, and/or an output device such as a printer, a speaker, etc. The power supply 750 may supply power for operating the system 700. The display device 760 may communicate with other components via the buses or other communication links.

As described above with reference to FIGS. 1 through 18, the display device 760 according to example embodiments of the inventive concept may reduce the source settling time and enhance performance of the display device by disposing a plurality of unit driving circuits to each connection node.

The example embodiments of the inventive concept may be applied to a display device or any system including a display device. For example, the example embodiments may be applied to a cellular phone, a smartphone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc., just to name a few of many possible applications.

The foregoing is illustrative of example embodiments of the inventive concept and is not to be construed as limiting thereof. Although some example embodiments have been described, an artisan will appreciate that many modifications are possible in the example embodiments described herein without materially departing from the scope of the appended claims.

What is claimed is:

1. A source driving circuit of a display device, comprising:

a plurality of unit driving circuits configured to drive a plurality of connection nodes connected to a display panel of the display device, each of the plurality of unit driving circuits comprising:

a plurality of driver circuits configured to perform analog-conversion and amplification operations on a plurality of digital data signals to generate a plurality of analog data signals so that each connection node of the plurality of connection nodes is driven by more than one of the plurality of driver circuits; and a plurality of output switches connected in parallel between the plurality of driver circuits and a corresponding connection node among the plurality of connection nodes, the plurality of output switches configured to transfer the plurality of analog data signals alternately to the corresponding connection node, wherein each of the plurality of driver circuits drives only one connection node.

2. The source driving circuit of claim 1, wherein each driver circuit of the plurality of driver circuits receives a corresponding digital data signal among the plurality of digital data signals and each driver circuit is configured to generate a corresponding analog data signal among the plurality of analog data signals in advance of a transfer of the corresponding analog data signal to the corresponding connection node.

3. The source driving circuit of claim 1, wherein each driver circuit of the plurality of driver circuits receives a plurality of pixel data sequentially through a corresponding analog data signal to drive a plurality of pixels connected to a corresponding gate line of the display panel.

4. The source driving circuit of claim 1, wherein each unit driving circuit of the plurality of unit driving circuits further comprises:

a plurality of latches configured to store a plurality of pixel data to drive a plurality pixels connected to a corresponding gate line of the display panel; and a plurality of input switches respectively connected to the plurality of latches, wherein the plurality of input switches are configured to connect the plurality of latches to an input node of at least one driver circuit of the plurality of driver circuits.

5. The source driving circuit of claim 4, wherein input switches from the plurality of input switches are grouped into a plurality of input switch groups, each input switch group among the plurality of input switch group providing a corresponding digital data signal among the plurality of digital data signals to an input node of a corresponding driver circuit among the plurality of driver circuits.

6. The source driving circuit of claim 5, wherein the input switches from the plurality of input switches included in each input switch group are turned on sequentially.

7. The source driving circuit of claim 5, wherein the input switches included in each input switch group are alternately turned on.

8. The source driving circuit of claim 5, wherein two input switches included in different groups of the plurality of input switch groups have a time interval during which the two input switches are turned on simultaneously.

9. The source driving circuit of claim 5, wherein each input switch is turned on to provide one pixel data through the corresponding digital data signal to the corresponding driver circuit before an output switch connected to the corresponding driver circuit is turned on to transfer an analog data signal of the plurality of analog data signals corresponding to the one pixel data to the corresponding connection node.

10. A source driving circuit of a display device, comprising;

a plurality of driver circuits including;

a first driver circuit configured to perform analog-conversion and amplification operations on a first digital data signal received through a first input node to output a first analog data signal through a first output node, and a second driver circuit configured to perform analog-conversion and amplification operations on a second digital data signal received through a second input node to output a second analog data signal through a second output node;

a first output switch connected between the first output node and a connection node connected to a display panel of the display device; and a second output switch connected between the second output node and the connection node;

a first group of input switches commonly connected to the first input node and configured to transfer a first group of pixel data as the first digital data signal to the first input node to drive a first group of pixels connected to a corresponding gate line of the display panel; and a second group of input switches commonly connected to the second input node and configured to transfer a second group of pixel data as the second digital data signal to the second input node to drive a second group of pixels connected to the corresponding gate line, wherein the connection node is driven by two or more driver circuits of the plurality of driver circuits.

11. The source driving circuit of claim 10, wherein the first output switch and the second output switch are turned on alternately.

12. The source driving circuit of claim 10, wherein the first group of input switches are turned on sequentially and the second group of input switches are turned on sequentially.

13. The source driving circuit of claim 10, wherein one input switch in the first group of input switches and one input switch in the second group of input switches are turned on simultaneously according to a time interval.

14. The source driving circuit of claim 10, wherein each of the first group of input switches and the second group of input switches includes one of: two input switches in a first pixel layout of the display panel configured as pentile structure, or three input switches in a second pixel layout of the display panel configured in an Red Green Blue (RGB) stripe structure.

15. The source driving circuit of claim 10, further comprising:

a first mode switch connected between the connection node and one of the first output switch and the second output switch; and a second mode switch connected between the first input node and the second input node.

16. The source driving circuit of claim 15, wherein the first mode switch is turned on and the second mode switch is turned off in a first operation mode, and the first mode switch is turned off and the second mode switch is turned on in a second operation mode.

17. A display device comprising:

a display panel comprising a plurality of pixels connected to a plurality of data lines and a plurality of gate lines; and a source driving circuit comprising a plurality of unit driving circuits configured to drive a plurality of connection nodes that are connected to the display panel, each of the plurality of unit driving circuits comprising:

a plurality of driver circuits configured to perform analog-conversion and amplification operations on a plurality of digital data signals to output a plurality of analog data signals; and a plurality of output switches connected in parallel between the plurality of driver circuits and a corresponding connection node among the plurality of connection nodes, the plurality of output switches configured to transfer the plurality of analog data signals alternately to the corresponding connection node so that each connection node of the plurality of connection nodes is driven by more than one of the plurality of driver circuits, wherein each of the plurality of driver circuits receives a corresponding digital data signal among the plurality of digital data signals to generate a corresponding analog data signal among the plurality of analog data signals in advance of transferring the corresponding analog data signal to the corresponding connection node.

18. The display device of claim 17, wherein the display panel further comprises:

a plurality of column switches configured to control electrical connections between the plurality of connection nodes and the plurality of data lines.

* * * * *